US009540826B2

(12) United States Patent
Pervan et al.

(10) Patent No.: US 9,540,826 B2
(45) Date of Patent: Jan. 10, 2017

(54) MECHANICAL LOCKINGS OF FLOOR PANELS AND A TONGUE BLANK

(71) Applicant: Valinge Innovation AB, Viken (SE)

(72) Inventors: Darko Pervan, Viken (SE); Christian Boo, Kagerod (SE)

(73) Assignee: VALINGE INNOVATION AB, Viken (SE)

( * ) Notice: Subject to any disclaimer, the term of this patent is extended or adjusted under 35 U.S.C. 154(b) by 0 days.

(21) Appl. No.: 15/072,858

(22) Filed: Mar. 17, 2016

(65) Prior Publication Data

US 2016/0194884 A1 Jul. 7, 2016

Related U.S. Application Data

(60) Continuation of application No. 14/206,214, filed on Mar. 12, 2014, now Pat. No. 9,309,679, which is a (Continued)

(30) Foreign Application Priority Data

Jan. 30, 2009 (WO) ..... PCT/SE2009/050103
Apr. 29, 2009 (SE) ..... 0900580

(51) Int. Cl.
*E04F 15/02* (2006.01)

(52) U.S. Cl.
CPC ..... *E04F 15/02038* (2013.01); *E04F 15/02* (2013.01); *E04F 2201/0115* (2013.01); (Continued)

(58) Field of Classification Search
CPC ..... E04F 15/02; E04F 15/02038; E04F 2201/0115; E04F 2201/0523; E04F 2201/0153; E04F 2201/0138; E04F 2201/0169;E04F 2201/0541; E04F 2201/0547
See application file for complete search history.

(56) References Cited

U.S. PATENT DOCUMENTS 261,030 A 7/1882 Orcutt
301,775 A 7/1884 Thompson
(Continued)

FOREIGN PATENT DOCUMENTS

CA 2456513 A1 2/2003
DE 299 22 649 U1 4/2000
(Continued)

OTHER PUBLICATIONS

International Search Report mailed May 29, 2009 in PCT/SE2009/050103, Swedish Patent Office, Stockholm, Sweden, 11 pages.
(Continued)

*Primary Examiner* — James Ference
(74) *Attorney, Agent, or Firm* — Buchanan Ingersoll & Rooney P.C.

(57) ABSTRACT

Floor panels which are provided with a mechanical locking system including tongue and grooves provided with protrusions and cavities which are displaceable in relation to each other. A set of floor panel provided with a locking system including a displaceable tongue in a displacement groove in a first edge of a first floor panel, cooperating for vertical locking of the edges with a tongue groove in adjacent second edges of a second floor panel, the locking system further including a locking strip with a locking element in one edge which cooperates, for horizontal locking of the edges, with a locking groove in an adjacent edge, the displaceable tongue includes a protrusion and the displacement groove a cavity, the protrusion is slideable against a wall of the cavity
(Continued)

to obtain a displacement of the tongue in a first direction perpendicular to the edges and thereby the vertical locking of the edges.

9 Claims, 24 Drawing Sheets

Related U.S. Application Data division of application No. 13/146,731, filed as application No. PCT/SE2009/051238 on Nov. 2, 2009, now Pat. No. 8,713,886.

(52) U.S. Cl.
CPC ..... *E04F 2201/0138* (2013.01); *E04F 2201/0153* (2013.01); *E04F 2201/0169* (2013.01); *E04F 2201/0523* (2013.01); *E04F 2201/0541* (2013.01); *E04F 2201/0547* (2013.01)

(56) References Cited

U.S. PATENT DOCUMENTS 526,044 A 9/1894 Merrill
917,352 A 4/1909 Palmer
1,352,620 A 9/1920 Onsrud
1,911,598 A 5/1933 Ashmun
2,005,647 A 5/1933 Crouch
2,054,828 A 9/1936 Melde
2,571,861 A 10/1951 Gegumis
2,791,247 A 5/1957 Gerson
2,863,185 A 5/1957 Riedl
2,876,812 A 3/1959 Waldron
3,082,802 A 3/1963 Dickson et al.
3,774,660 A 11/1973 Morey et al.
3,778,954 A 12/1973 Meserole
3,817,305 A 6/1974 Gibbs
3,913,642 A 10/1975 Porter
3,986,543 A 10/1976 Slayton et al.
4,082,129 A 4/1978 Morelock
4,151,869 A 5/1979 Halloran et al.
5,026,112 A 6/1991 Rice
5,182,892 A 2/1993 Chase
5,348,778 A 9/1994 Knipp et al.
5,694,730 A 12/1997 Del Rincon et al.
6,164,349 A 12/2000 Hsieh
6,164,351 A 12/2000 Weathers
6,345,481 B1 2/2002 Nelson
6,363,677 B1 4/2002 Chen et al.
6,385,936 B1 * 5/2002 Schneider ..... E04F 15/02 403/364
6,386,250 B1 5/2002 Liu
6,450,235 B1 9/2002 Lee
6,591,568 B1 * 7/2003 Palsson ..... E04F 15/02 52/50
6,617,009 B1 9/2003 Chen et al.
6,647,689 B2 * 11/2003 Pletzer ..... E04F 15/04 403/364
6,647,690 B1 * 11/2003 Martensson ..... E04F 15/02 52/489.1
6,685,391 B1 * 2/2004 Gideon ..... E01C 3/06 405/16
6,766,622 B1 * 7/2004 Thiers ..... E04F 15/04 144/364
6,804,926 B1 10/2004 Eisermann
6,862,857 B2 3/2005 Tychsen
6,874,291 B1 4/2005 Weber
6,880,307 B2 4/2005 Schwitte et al.
7,051,486 B2 5/2006 Pervan
7,152,383 B1 12/2006 Wilkinson et al.
7,337,588 B1 3/2008 Moebus
7,451,578 B2 11/2008 Hannig
7,454,875 B2 11/2008 Pervan et al.
7,516,588 B2 4/2009 Pervan
7,533,500 B2 5/2009 Morton et al.
7,584,583 B2 9/2009 Bergelin et al.
7,621,092 B2 11/2009 Groeke et al.
7,634,884 B2 12/2009 Pervan
7,637,068 B2 12/2009 Pervan
7,644,742 B2 1/2010 Burkholder
7,654,055 B2 * 2/2010 Ricker ..... A47B 47/0075 52/582.2
7,677,005 B2 3/2010 Pervan
7,716,889 B2 * 5/2010 Pervan ..... E04F 15/02 52/392
7,721,503 B2 5/2010 Pervan et al.
7,726,088 B2 6/2010 Muehlebach
7,757,452 B2 7/2010 Pervan
7,802,411 B2 9/2010 Pervan
7,841,144 B2 11/2010 Pervan et al.
7,841,145 B2 11/2010 Pervan et al.
7,841,150 B2 11/2010 Pervan
7,856,789 B2 12/2010 Eisermann
7,861,482 B2 1/2011 Pervan et al.
7,866,110 B2 1/2011 Pervan
7,908,815 B2 3/2011 Pervan et al.
7,930,862 B2 * 4/2011 Bergelin ..... E04F 15/02 428/192
7,954,523 B2 6/2011 Liu
7,980,039 B2 * 7/2011 Groeke ..... E04F 15/02 403/350
7,980,041 B2 7/2011 Pervan
8,033,074 B2 10/2011 Pervan
8,042,311 B2 10/2011 Pervan
8,061,104 B2 * 11/2011 Pervan ..... E04F 15/02 52/591.1
8,079,196 B2 12/2011 Pervan
8,112,967 B2 2/2012 Pervan et al.
8,171,692 B2 5/2012 Pervan
8,181,416 B2 5/2012 Pervan et al.
8,234,830 B2 8/2012 Pervan et al.
8,281,549 B2 10/2012 Du
8,302,367 B2 11/2012 Schulte
8,336,272 B2 * 12/2012 Prager ..... F16B 5/0044 52/588.1
8,341,914 B2 1/2013 Pervan et al.
8,341,915 B2 1/2013 Pervan et al.
8,353,140 B2 1/2013 Pervan et al.
8,359,805 B2 1/2013 Pervan et al.
8,381,477 B2 2/2013 Pervan et al.
8,387,327 B2 3/2013 Pervan
8,448,402 B2 5/2013 Pervan et al.
8,499,521 B2 8/2013 Pervan et al.
8,505,257 B2 8/2013 Boo et al.
8,516,767 B2 * 8/2013 Engstrom ..... E04F 15/02 52/586.1
8,528,289 B2 9/2013 Pervan et al.
8,544,230 B2 10/2013 Pervan
8,544,234 B2 10/2013 Pervan et al.
8,572,922 B2 11/2013 Pervan
8,596,013 B2 12/2013 Boo
8,627,862 B2 1/2014 Pervan et al.
8,640,424 B2 2/2014 Pervan et al.
8,650,826 B2 2/2014 Pervan et al.
8,677,714 B2 3/2014 Pervan
8,689,512 B2 4/2014 Pervan
8,707,650 B2 4/2014 Pervan
8,713,886 B2 5/2014 Boo et al.
8,733,065 B2 5/2014 Pervan
8,733,410 B2 5/2014 Pervan
8,763,341 B2 7/2014 Pervan
8,769,905 B2 7/2014 Pervan
8,776,473 B2 7/2014 Pervan et al.
8,844,236 B2 9/2014 Pervan et al.
8,857,126 B2 10/2014 Pervan et al.
8,869,485 B2 10/2014 Pervan
8,898,988 B2 12/2014 Pervan
8,925,274 B2 1/2015 Darko et al.
8,959,866 B2 2/2015 Pervan
8,973,331 B2 3/2015 Boo
9,027,306 B2 5/2015 Pervan
9,051,738 B2 6/2015 Pervan et al.

(56) References Cited

U.S. PATENT DOCUMENTS 9,068,360 B2 6/2015 Darko
9,091,077 B2 7/2015 Boo
9,194,134 B2 11/2015 Nygren et al.
9,212,492 B2 12/2015 Pervan et al.
9,216,541 B2 12/2015 Boo et al.
9,238,917 B2 1/2016 Pervan et al.
9,284,737 B2 3/2016 Pervan et al.
9,309,679 B2 4/2016 Pervan et al.
9,316,002 B2 4/2016 Boo
9,340,974 B2 5/2016 Pervan et al.
9,347,469 B2 5/2016 Pervan
9,359,774 B2 6/2016 Pervan
2002/0069611 A1 6/2002 Leopolder
2002/0092263 A1 7/2002 Schulte
2002/0095894 A1* 7/2002 Pervan ..... E04F 15/02 52/391
2002/0170259 A1 11/2002 Ferris
2002/0178674 A1* 12/2002 Pervan ..... E04F 15/02 52/385
2003/0009971 A1 1/2003 Palmberg
2003/0009972 A1* 1/2003 Pervan ..... B23P 11/00 52/582.1
2003/0024199 A1* 2/2003 Pervan ..... E04F 15/02005 52/589.1
2003/0037504 A1* 2/2003 Schwitte ..... E04F 15/02 52/586.1
2003/0084636 A1* 5/2003 Pervan ..... E04F 15/04 52/592.1
2003/0101681 A1 6/2003 Tychsen
2004/0016196 A1 1/2004 Pervan
2004/0049999 A1 3/2004 Krieger
2004/0060255 A1* 4/2004 Knauseder ..... E04F 13/10 52/582.2
2004/0128934 A1* 7/2004 Hecht ..... E04F 15/02 52/578
2004/0139678 A1* 7/2004 Pervan ..... B44C 3/12 52/578
2004/0177584 A1 9/2004 Pervan
2004/0182036 A1* 9/2004 Sjoberg ..... E04F 15/02 52/592.1
2004/0211143 A1 10/2004 Hannig
2004/0250492 A1* 12/2004 Becker ..... E04F 15/04 52/578
2005/0050827 A1* 3/2005 Schitter ..... B44C 5/043 52/578
2005/0160694 A1* 7/2005 Pervan ..... B27F 1/02 52/582.1
2005/0166514 A1* 8/2005 Pervan ..... B27F 5/026 52/578
2005/0210810 A1* 9/2005 Pervan ..... E04F 15/04 52/578
2006/0070333 A1 4/2006 Pervan
2006/0101769 A1* 5/2006 Pervan ..... E04F 15/02 52/591.1
2006/0174577 A1 8/2006 O'Neil
2006/0174578 A1* 8/2006 Konstanczak ..... E04F 15/04 52/589.1
2006/0236642 A1* 10/2006 Pervan ..... E04F 15/02 52/578
2006/0260254 A1 11/2006 Pervan et al.
2007/0006543 A1* 1/2007 Engstrom ..... E04F 15/02 52/582.1
2007/0011981 A1 1/2007 Eisermann
2007/0028547 A1 2/2007 Grafenauer et al.
2007/0175156 A1 8/2007 Pervan et al.
2007/0193178 A1 8/2007 Groeke et al.
2007/0209736 A1 9/2007 Deringor et al.
2007/0214741 A1 9/2007 Llorens Miravet
2008/0000182 A1* 1/2008 Pervan ..... E04F 15/02 52/478
2008/0000186 A1 1/2008 Pervan et al.
2008/0000187 A1 1/2008 Pervan et al.
2008/0010931 A1 1/2008 Pervan et al.
2008/0010937 A1* 1/2008 Pervan ..... E04F 15/02 52/588.1
2008/0017274 A1 1/2008 Burkholder
2008/0028707 A1* 2/2008 Pervan ..... E04F 15/02 52/391
2008/0028713 A1* 2/2008 Pervan ..... E04C 2/20 52/586.1
2008/0034708 A1 2/2008 Pervan
2008/0041007 A1* 2/2008 Pervan ..... B44C 1/28 52/506.01
2008/0041008 A1 2/2008 Pervan
2008/0066415 A1 3/2008 Pervan
2008/0104921 A1* 5/2008 Pervan ..... E04F 15/02 52/588.1
2008/0110125 A1* 5/2008 Pervan ..... E04F 15/02 52/582.2
2008/0134607 A1* 6/2008 Pervan ..... E04F 15/02038 52/395
2008/0134613 A1* 6/2008 Pervan ..... E04F 15/02 52/582.2
2008/0134614 A1 6/2008 Pervan
2008/0155930 A1 7/2008 Pervan et al.
2008/0209838 A1 9/2008 Pervan
2008/0216434 A1 9/2008 Pervan
2008/0216920 A1 9/2008 Pervan
2008/0241440 A1 10/2008 Bauer
2008/0295432 A1 12/2008 Pervan et al.
2009/0019806 A1* 1/2009 Muehlebach ..... E04F 15/02 52/588.1
2009/0133353 A1* 5/2009 Pervan ..... E04F 15/02 52/588.1
2009/0193741 A1* 8/2009 Cappelle ..... E04F 15/02 52/309.1
2009/0193748 A1* 8/2009 Boo ..... B27F 1/02 52/589.1
2010/0043921 A1 2/2010 Liu
2010/0135740 A1 6/2010 Harif
2010/0293879 A1* 11/2010 Pervan ..... E04F 15/02 52/588.1
2010/0300029 A1* 12/2010 Braun ..... E04F 15/02 52/588.1
2010/0300031 A1 12/2010 Pervan et al.
2010/0319290 A1 12/2010 Pervan
2010/0319291 A1* 12/2010 Pervan ..... E04F 15/02 52/588.1
2011/0030303 A1* 2/2011 Pervan ..... B27F 1/08 52/582.1
2011/0041996 A1 2/2011 Pervan
2011/0088344 A1 4/2011 Pervan et al.
2011/0088345 A1 4/2011 Pervan
2011/0131916 A1* 6/2011 Chen ..... E04F 15/02 52/588.1
2011/0154763 A1 6/2011 Bergelin et al.
2011/0167750 A1* 7/2011 Pervan ..... E04F 15/04 52/588.1
2011/0197535 A1* 8/2011 Baker ..... E04B 1/6116 52/588.1
2011/0225922 A1* 9/2011 Pervan ..... E04F 13/0894 52/588.1
2011/0252733 A1 10/2011 Pervan
2011/0283650 A1 11/2011 Pervan et al.
2012/0017533 A1 1/2012 Pervan et al.
2012/0031029 A1 2/2012 Pervan et al.
2012/0036804 A1 2/2012 Pervan
2012/0151865 A1 6/2012 Pervan et al.
2012/0174515 A1 7/2012 Pervan
2012/0174520 A1 7/2012 Pervan
2012/0192521 A1* 8/2012 Schulte ..... E04F 13/08 52/588.1
2012/0279161 A1 11/2012 Håkansson et al.
2013/0008117 A1* 1/2013 Pervan ..... E04F 15/02 52/588.1
2013/0014463 A1* 1/2013 Pervan ..... E04F 15/02038 52/588.1
2013/0019555 A1* 1/2013 Pervan ..... E04F 15/02038 52/588.1

(56) References Cited

U.S. PATENT DOCUMENTS

| | | | | |
|---|---|---|---|---|
| 2013/0036695 | A1* | 2/2013 | Durnberger | E04F 15/02038 52/309.3 |
| 2013/0042562 | A1* | 2/2013 | Pervan | E04F 15/02038 52/582.2 |
| 2013/0042563 | A1* | 2/2013 | Pervan | E04F 15/02038 52/582.2 |
| 2013/0042564 | A1* | 2/2013 | Pervan | E04F 13/0894 52/588.1 |
| 2013/0042565 | A1 | 2/2013 | Pervan | |
| 2013/0047536 | A1 | 2/2013 | Pervan | |
| 2013/0081349 | A1 | 4/2013 | Pervan et al. | |
| 2013/0111845 | A1 | 5/2013 | Pervan | |
| 2013/0145708 | A1 | 6/2013 | Pervan | |
| 2013/0160391 | A1 | 6/2013 | Pervan et al. | |
| 2013/0232905 | A2 | 9/2013 | Pervan | |
| 2013/0239508 | A1 | 9/2013 | Darko et al. | |
| 2013/0263454 | A1 | 10/2013 | Boo et al. | |
| 2013/0263547 | A1 | 10/2013 | Boo | |
| 2013/0318906 | A1 | 12/2013 | Pervan et al. | |
| 2014/0007539 | A1 | 1/2014 | Pervan et al. | |
| 2014/0020324 | A1 | 1/2014 | Pervan | |
| 2014/0033634 | A1 | 2/2014 | Pervan | |
| 2014/0053497 | A1 | 2/2014 | Pervan et al. | |
| 2014/0059966 | A1 | 3/2014 | Boo | |
| 2014/0069043 | A1 | 3/2014 | Pervan | |
| 2014/0090335 | A1 | 4/2014 | Pervan et al. | |
| 2014/0109501 | A1 | 4/2014 | Darko | |
| 2014/0109506 | A1 | 4/2014 | Pervan et al. | |
| 2014/0123586 | A1 | 5/2014 | Pervan et al. | |
| 2014/0150369 | A1 | 6/2014 | Hannig | |
| 2014/0190112 | A1 | 7/2014 | Pervan | |
| 2014/0208677 | A1 | 7/2014 | Pervan et al. | |
| 2014/0223852 | A1 | 8/2014 | Pervan | |
| 2014/0237931 | A1 | 8/2014 | Pervan | |
| 2014/0250813 | A1 | 9/2014 | Nygren et al. | |
| 2014/0260060 | A1 | 9/2014 | Pervan et al. | |
| 2014/0305065 | A1 | 10/2014 | Pervan | |
| 2014/0366476 | A1 | 12/2014 | Pervan | |
| 2014/0373478 | A2 | 12/2014 | Pervan et al. | |
| 2014/0373480 | A1 | 12/2014 | Pervan et al. | |
| 2015/0000221 | A1 | 1/2015 | Boo | |
| 2015/0013260 | A1 | 1/2015 | Pervan | |
| 2015/0059281 | A1 | 3/2015 | Pervan | |
| 2015/0089896 | A2 | 4/2015 | Pervan et al. | |
| 2015/0121796 | A1 | 5/2015 | Pervan | |
| 2015/0152644 | A1 | 6/2015 | Boo | |
| 2015/0167318 | A1 | 6/2015 | Pervan | |
| 2015/0211239 | A1 | 7/2015 | Pervan | |
| 2015/0233125 | A1 | 8/2015 | Pervan et al. | |
| 2015/0267419 | A1 | 9/2015 | Darko | |
| 2015/0300029 | A1 | 10/2015 | Pervan | |
| 2015/0330088 | A1 | 11/2015 | Derelov | |
| 2015/0337537 | A1 | 11/2015 | Boo | |
| 2016/0032596 | A1 | 2/2016 | Nygren et al. | |
| 2016/0060879 | A1 | 3/2016 | Pervan | |
| 2016/0069088 | A1 | 3/2016 | Boo et al. | |
| 2016/0076260 | A1 | 3/2016 | Pervan et al. | |
| 2016/0090744 | A1 | 3/2016 | Pervan et al. | |
| 2016/0153200 | A1 | 6/2016 | Pervan | |

FOREIGN PATENT DOCUMENTS

| | | | |
|---|---|---|---|
| DE | 200 01 788 | U1 | 6/2000 |
| DE | 10 2004 055 951 | A1 | 7/2005 |
| DE | 10 2006 024 184 | A1 | 11/2007 |
| DE | 10 2006 037 614 | B3 | 12/2007 |
| DE | 10 2007 018 309 | A1 | 8/2008 |
| DE | 10 2007 016 533 | A1 | 10/2008 |
| DE | 10 2007 032 885 | A1 | 1/2009 |
| DE | 10 2007 018 309 | B4 | 7/2013 |
| EP | 0 974 713 | A1 | 1/2000 |
| EP | 1 420 125 | A2 | 5/2004 |
| EP | 1 650 375 | A1 | 4/2006 |
| EP | 1 650 375 | A8 | 9/2006 |
| FR | 1.138.595 | | 6/1957 |
| FR | 2 256 807 | | 8/1975 |
| SE | 529 076 | C2 | 4/2007 |
| WO | WO 94/26999 | A1 | 11/1994 |
| WO | WO 97/47834 | A1 | 12/1997 |
| WO | WO 01/02671 | A1 | 1/2001 |
| WO | WO 01/02672 | A1 | 1/2001 |
| WO | WO 01/38657 | A1 | 5/2001 |
| WO | WO 01/48332 | A1 | 7/2001 |
| WO | WO 01/51732 | A1 | 7/2001 |
| WO | WO 01/75247 | A1 | 10/2001 |
| WO | WO 03/016654 | A1 | 2/2003 |
| WO | WO 03/038210 | A1 | 5/2003 |
| WO | WO 03/069094 | A1 | 8/2003 |
| WO | WO 03/083234 | A1 | 10/2003 |
| WO | WO 2004/048716 | A1 | 6/2004 |
| WO | WO 2004/079130 | A1 | 9/2004 |
| WO | WO 2004/085765 | A1 | 10/2004 |
| WO | WO 2006/043893 | A1 | 4/2006 |
| WO | WO 2006/104436 | A1 | 10/2006 |
| WO | WO 2007/015669 | A2 | 2/2007 |
| WO | WO 2007/020088 | A1 | 2/2007 |
| WO | WO 2007/089186 | A1 | 8/2007 |
| WO | WO 2007/118352 | A1 | 10/2007 |
| WO | WO 2008/004960 | A2 | 1/2008 |
| WO | WO 2008/004960 | A8 | 1/2008 |
| WO | WO 2008/017281 | A1 | 2/2008 |
| WO | WO 2008/017301 | A2 | 2/2008 |
| WO | WO 2008/017301 | A3 | 2/2008 |
| WO | WO 2008/116623 | A1 | 10/2008 |
| WO | WO 2008/122479 | A1 | 10/2008 |
| WO | WO 2009/116926 | A1 | 9/2009 |
| WO | WO 2010/087752 | A1 | 8/2010 |

OTHER PUBLICATIONS

International Search Report mailed May 26, 2010 in PCT/SE2009/051238, Swedish Patent Office, Stockholm, Sweden, 8 pages.

Välinge Innovation AB, Technical Disclosure entitled "Mechanical locking for floor panels with a flexible bristle tongue," IP.com No. IPCOM000145262D, Jan. 12, 2007, IP.com PriorArtDatabase, 57 pages.

Engstrand, Ola (Contact)/Välinge Innovation AB, Technical Disclosure entitled "VA043 5G Linear Slide Tongue," IP com No. IPCOM000179015D, Feb. 4, 2009, IP.com Prior Art Database, 126 pages.

Pervan, Darko, et al. U.S. Appl. No. 15/133,735 entitled "Mechanical Locking of Floor Panels," filed Apr. 20, 2016.

* cited by examiner

Prior Art

Prior Art

Fig. 8a
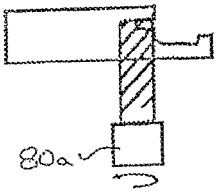
Fig. 8b
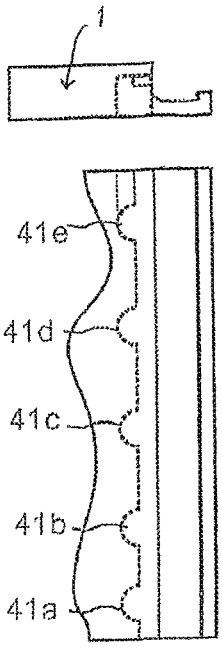
Fig. 8c
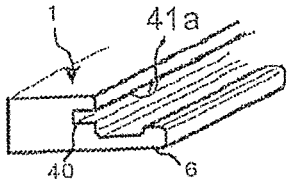
Fig. 8d
Fig. 8e
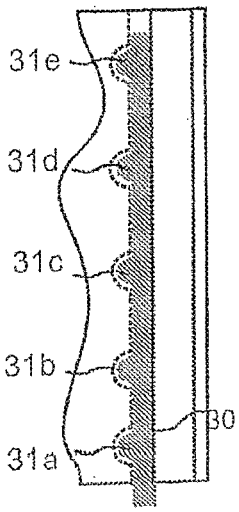
Fig. 8f
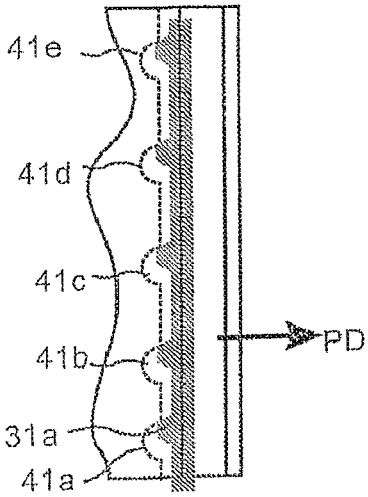

Fig. 9a
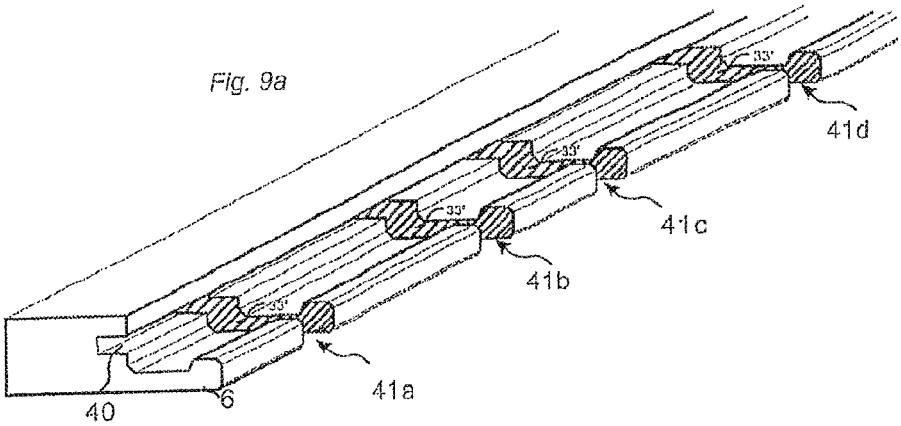
Fig. 9b
Fig. 9c
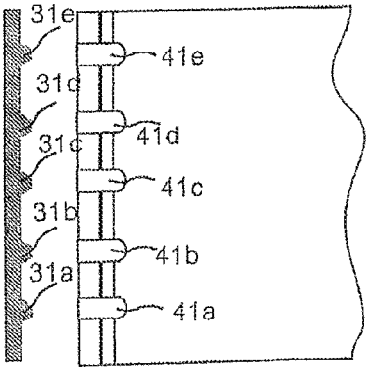
Fig. 9d
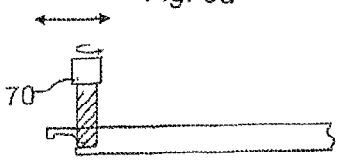

Fig. 16a
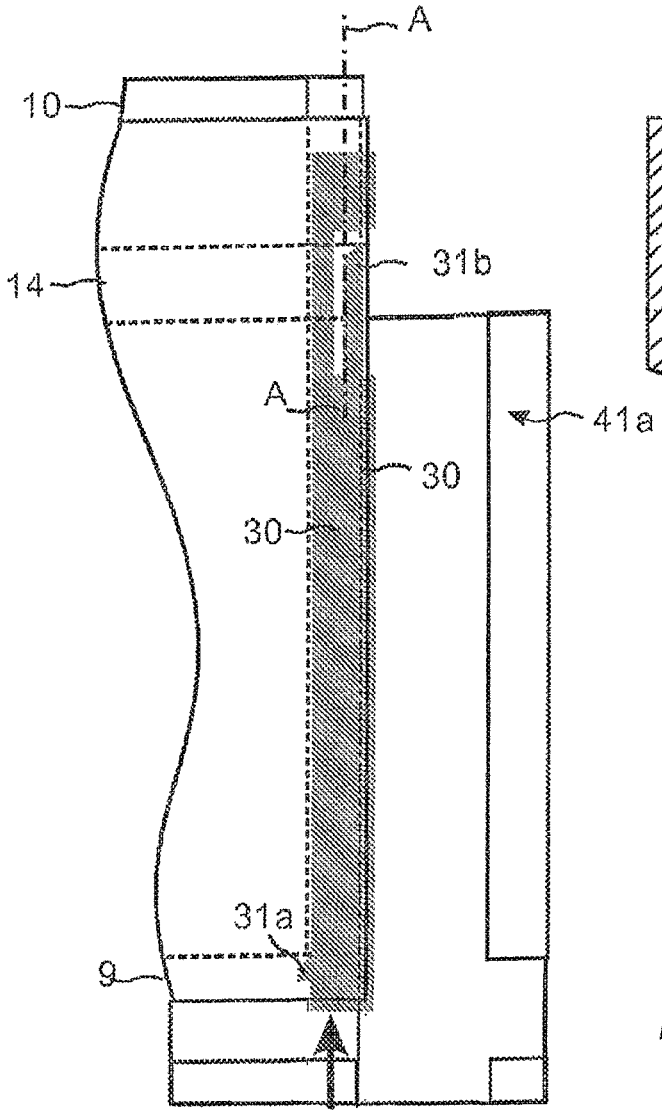
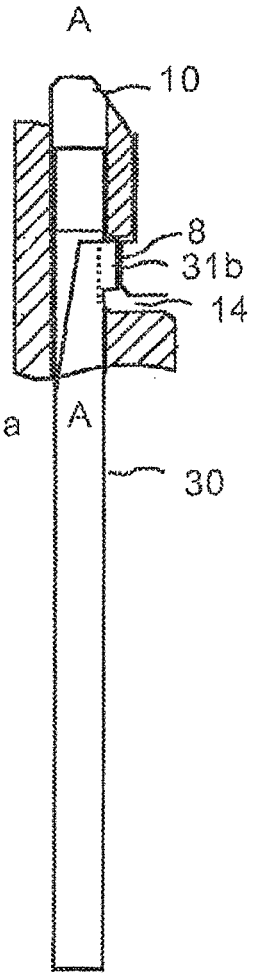
Fig. 16b
Fig. 16c
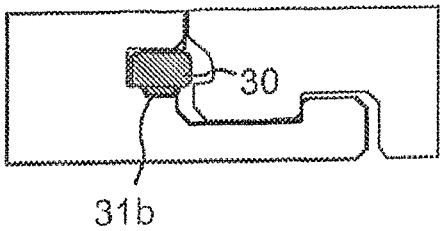

Fig. 24a
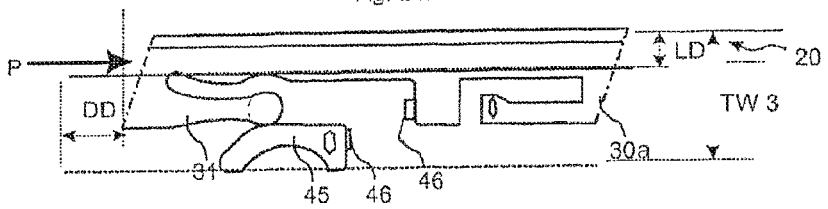
Fig. 24b
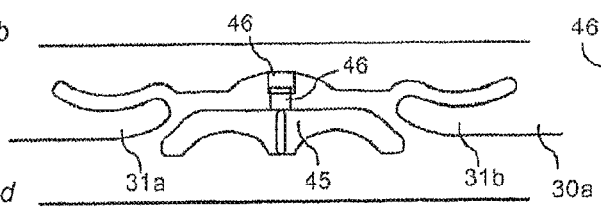
Fig. 24c
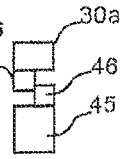
Fig. 24d
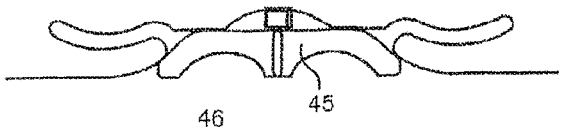
Fig. 24e
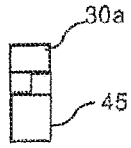
Fig. 24f
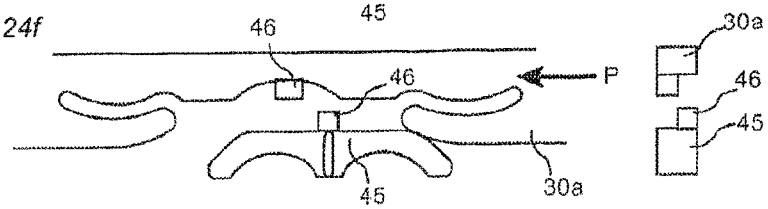
Fig. 24g
Fig. 24h
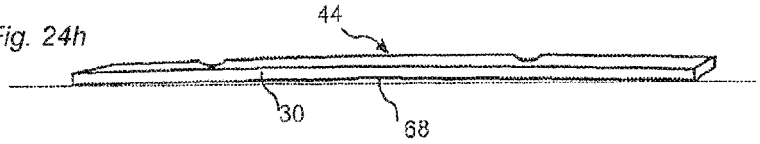
Fig. 24i
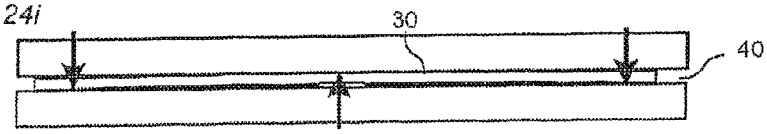

MECHANICAL LOCKINGS OF FLOOR PANELS AND A TONGUE BLANK

CROSS-REFERENCE TO RELATED APPLICATIONS

The present application is a continuation of U.S. application Ser. No. 14/206,214, filed on Mar. 12, 2014, which is a divisional of U.S. application Ser. No. 13/146,731, filed on Jul. 28, 2011, now U.S. Pat. No. 8,713,886, which is a national stage application of International Application No. PCT/SE2009/051238, filed on Nov. 2, 2009, which claims priority to International Application No. PCT/SE2009/050103, filed on Jan. 30, 2009, and to Swedish Application No. 0900580-2, filed on Apr. 29, 2009. The entire contents of U.S. application Ser. Nos. 14/206,214, 13/146,731, U.S. Pat. No. 8,713,886, International Application No. PCT/SE2009/051238, International Application No. PCT/SE2009/050103, and Swedish Application No. 0900580-2 are hereby incorporated herein by reference in their entirety.

AREA OF INVENTION

The invention generally relates to the field of floor panels with mechanical locking systems comprising a separate displaceable tongue allowing easy installation. The invention provides new improved locking systems and methods to install and disconnect building panels, especially floor panels and methods to produce the locking system.

BACKGROUND OF THE INVENTION

In particular, yet not restrictive manner, the invention concerns a mechanical locking system for rectangular floor panels with long and short edges, which could be installed with vertical folding. It should be emphasized that long and short edges are only used to simplify the description. The panels could also be square, they could have more than 4 edges and the adjacent edges could have angles other than 90 degrees. However, the invention is as well applicable to building panels in general. More particularly the invention relates mainly to the type of mechanically locking systems, which allow that angling of long edges and vertical movement of short edges could lock all four edges of a panel to other panels with a single action method generally referred to as vertical folding.

Floor panel of this type are presented in WO 2008/004960 (Applicant Valinge Innovation AB) and WO 2008/017301 (Schulte). The main principles are shown in FIG. 1*a*-1*d*.

FIG. 1*a* shows that two adjacent short edges in a first row could be locked with a displaceable tongue (30) which is displaced, as shown in FIG. 1*b*, by a side push at one edge section (32) when the adjacent short edges 1*b*, 1*c* have been folded down and positioned in the same plane. This vertical "side push" folding, which generally is activated by a pressure P from a long side of a third panel 1*d* in a second row, displaces the separate and displaceable tongue 30 along the short edge joint 1*b* but also perpendicular to the joint direction D2 such that a part of the tongue is displaced into a tongue groove 20 of the adjacent short edge 1*c*. FIG. 1*c* show that the displaceable tongue 30 is located in a displacement groove 40, which has a cavity 41. This cavity cooperates with a protrusion 31 on the displaceable tongue such that the displaceable tongue 30, when pushed along the edge and the displacement groove, is also displaced perpendicularly to the edge in D2 and into a tongue groove 20 of an adjacent panel. FIGS. 2*a*-2*d* show a known method to form a cavity 41. A rotating tool 71, similar to a thin saw blade, rotates in a horizontal plane HP parallel with the panel surface and forms a cavity 41. The main disadvantage is that the tool will form a cavity 41 with a considerable depth as shown in FIG. 2*d*.

A side push locking system according to known technology that requires that a displacement groove is formed which is not parallel to the edge is very difficult to produce and deep grooves will have a negative effect on the stability and strength of the panel edge. As an alternative wedge shape tongues consisting generally of two parts, which are not parallel with the edge could be used. Such tongues are expensive and complicated to produce and insert into an edge.

The main disadvantage of side push systems of this kind compared to other mechanical locking systems is that it is difficult to form cavities that cooperates with protrusion on a displaceable tongue in a precise and cost effective way and to avoid negative effects on the stability and the strength of the panel edge.

DEFINITION OF SOME TERMS

In the following text, the visible surface of the installed floor panel is called "front face", while the opposite side of the floor panel, facing the sub floor, is called "rear face". The edge between the front and rear face is called "joint edge". If not defined otherwise upper and lower means towards the front face and towards the rear face. Inner and outer means towards or away from the center of the panel. By "horizontal plane" is meant a plane, which extends parallel to the outer part of the surface layer. Immediately juxtaposed upper parts of two adjacent joint edges of two joined floor panels together define a "vertical plane" perpendicular to the horizontal plane. By "horizontally" is meant parallel with the horizontal plane and by "Vertically" parallel to the vertical plane.

By "joint" or "locking system" are meant co acting connecting means, which connect the floor panels vertically and/or horizontally. By "Strip panel" is meant a panel edge that comprises a strip and a locking element and by "groove panel" is meant a panel edges that comprises a locking groove, which cooperates with the locking element in the horizontal locking.

By "vertical push folding" is meant an installation method where the short edges of two panels are locked when they are laying flat on a sub floor after the angling. The vertical locking is obtained by a side push that displaces a separate tongue in the length direction of the short edges. The horizontal locking is in conventional fold down systems obtained in the same way as for the angling systems with a locking element in one edge of a strip panel that cooperates with a locking groove on another edge of a groove panel. By "side push locking system" is meant a locking system, which could be locked with the vertical push folding method.

By "tongue width" is meant the maximum distance between two parallel lines along the length of a tongue that are in contact with the most outer and inner part of the tongue.

SUMMARY OF THE INVENTION

The general objective of the present invention is to improve the function and strength of a side push locking system and particularly of those parts that cause a displaceable tongue to move perpendicularly to an edge from one groove and into an adjacent groove when the displaceable tongue is displaced along the edge.

According to a first aspect of the invention a floor panels is provided with a locking system comprising a displaceable tongue in a displacement groove in a first edge and a tongue groove in adjacent second edges for vertical locking. A locking strip with a locking element in the first edge cooperates with a locking groove in the second edge for horizontal locking. The displaceable tongue comprises a protrusion and the displacement groove a cavity such that the protrusion is sliding against a cavity wall and in a first direction perpendicular to the edge when the displaceable tongue is displaced in a second direction along the edge. The displacement in the first direction causes the displaceable tongue to enter into the tongue groove whereby the edges are locked vertically. The cavity extends vertically downwards to the rear side of the panel.

The advantage is that a simple machining could be used to form the cavities and such forming will not have an adverse effect on the strength and stability of the edge.

The cavity is according to a preferred embodiment a blind hole surrounded by an essentially vertical wall.

Such cavity provide an extremely stable edge and a minimum of material must be removed.

According to a second aspect of the invention a floor panels is provided with a locking system comprising a displaceable tongue in a displacement groove in a first edge and a tongue groove in adjacent second edges for vertical locking. A locking strip with a locking element in the first edge cooperates with a locking groove in the second edge for horizontal locking. The displaceable tongue comprises a protrusion and the displacement groove a cavity such that the protrusion is sliding against a cavity wall and in a first direction perpendicular to the edge when the displaceable tongue is displaced in a second direction along the edge. The displacement in the first direction causes the displaceable tongue to enter into the tongue groove whereby the edges are locked vertically. The protrusion is flexible and configured to exert a horizontal pre tension against the tongue groove.

This second aspect offers the advantages that the negative effects of production tolerances could be reduced and an improved locking quality could be reached.

According to a third aspect of the invention a floor panels is provided with a locking system comprising a displaceable tongue in a displacement groove in a first edge and a tongue groove in adjacent second edges for vertical locking. A locking strip with a locking element in the first edge cooperates with a locking groove in the second edge for horizontal locking. The displaceable tongue comprises a protrusion and the displacement groove a cavity such that the protrusion is sliding against a cavity wall and in a first direction perpendicular to the edge when the displaceable tongue is displaced in a second direction along the edge. The displacement in the first direction causes the displaceable tongue to enter into the tongue groove whereby the edges are locked vertically. The protrusion is located on the lower and/or upper part of the displaceable tongue.

The third aspect offers the advantage that it possible to form a displacement groove with small depth and improved stability and strength could be reached.

According to a fourth aspect of the invention a set of floor panels are provided with a locking system comprising a displaceable tongue having a main tongue body and at least two wedge parts located in a displacement groove in a first edge of a first floor panel, cooperating for vertical locking of the edges with a tongue groove in adjacent second edge of a second floor panel. The locking system further comprises a locking strip with a locking element in one edge, which cooperates, for horizontal locking of the edges, with a locking groove in an adjacent edge. The main tongue body comprises at least two flexible protrusions and two recesses. The wedge parts are located at least partly in the recesses. The flexible protrusions are slideable against the wedge parts to obtain a displacement of the main tongue body perpendicular to the edges and thereby causing the vertical locking of the edges. The flexible protrusions are in unlocked position essentially displaced along the displaceable tongue in relation to the wedges and configured to exert a pre-tension against the wedge parts and the tongue groove. The main tongue body comprises a friction connection that allows displacement along the displacement groove and prevents the main tongue body to fall out from the displacement groove. The wedge parts comprise friction connection that prevents the wedge parts to be displaced in the displacement groove when the main tongue body is displaced along the edge. The wedge parts and the main tongue body comprise releasable wedge part connections adapted to be released during the insertion of the displaceable tongue into the displacement groove.

The fourth aspect offers the advantages that the edge could be formed with only a simple machining parallel to the edges in the same way as conventional mechanical locking systems. The displaceable tongue could be formed in a cost efficient way as a one-piece component and converted to a two-piece component during a controlled insertion of the tongue into a groove.

According to a fifth aspect of the invention a tongue blank is provided comprising at least two tongues having a tongue length and being connected to each other. The tongues are adapted to be separated from each other and inserted into an edge groove of a floor panel. Each tongue comprises a main tongue body comprising at least two protrusions extending essentially in the tongue length direction and two recesses. The tongue comprises two wedge parts located at least partly in or adjacent to the recesses. The main tongue body and the wedge parts comprise releasable wedge part connections adapted to be released from the main tongue body during the insertion of the tongue into the groove.

The fifth aspect offers the advantages that the tongues could be produced, handled and inserted into a groove in a simple and cost efficient way.

All embodiments of the first, second, third, fourth and fifth aspects could be combined and the flexible protrusion could for example be used together with a cavity extending to the rear side and being located on an upper and/or lower side of the displaceable tongue.

The invention provides for new embodiments of locking systems preferably at short edges but also at long edges or in square panels. Useful areas for the invention are wall panels, ceilings, exterior applications and floor panels of any shape and material e.g. laminate; especially panels with surface materials contain thermosetting resins, wood, HDF, veneer or stone.

Almost all embodiments of the locking system are described with a displacement groove and a displaceable tongue on the strip panel, mainly in order to simplify the description. It is obvious that the main principle or the invention could also be used on the locking groove side. A tongue is inserted into a displacement groove in one edge, which is located adjacent, and preferably above the locking groove and a tongue groove is formed in another edge adjacent to the locking strip and preferably essentially above the strip.

BRIEF DESCRIPTION OF THE DRAWINGS

FIGS. 8*a*-8*f* show a locking system with a cavity formed by cutters as a drilled blind hole.

FIGS. 9*a*-9*d* show locking systems with horizontally open cavities formed by cutters.

FIGS. 16*a*-16*c* show a locking system utilizing cavities, which are formed in connection to the forming of the long edge locking system.

FIGS. 24*a*-24*i* show embodiments according to the main principles of the invention.

DESCRIPTION OF EMBODIMENTS OF THE INVENTION

FIGS. 3*a*-3*e* show a production method to form cavities 41*a-d* according to a cutter principle. Several cutters 70*a-d* could be used, one for each cavity. The forming could take place before or after forming of the profile.

Figure 3A:
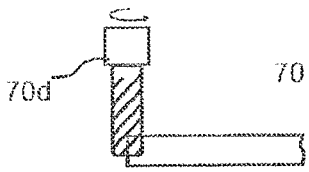
FIGS. 3*a*-3*f* show a production method to form cavities in an edge of a panel.
Figure 3B:
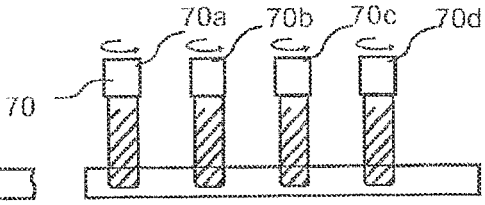
Figure 3C:
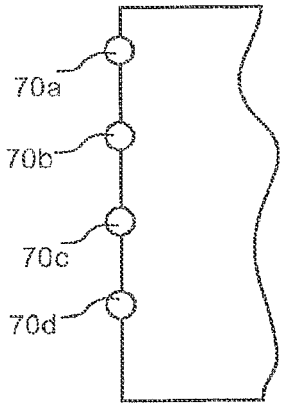
Figure 3D:
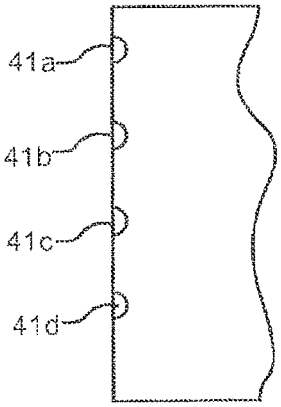

FIG. 3*a* shows that the cuter principle could form a cavity, which is smaller than the diameter of the cutter.

Figure 3E:
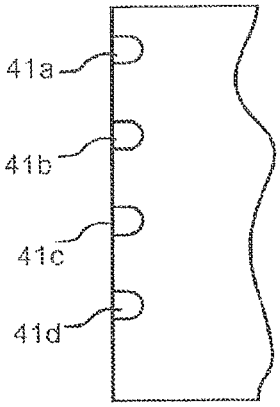
Figure 3F:
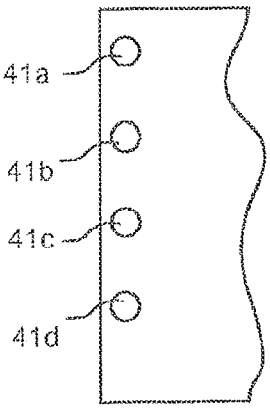
Figure 4A:
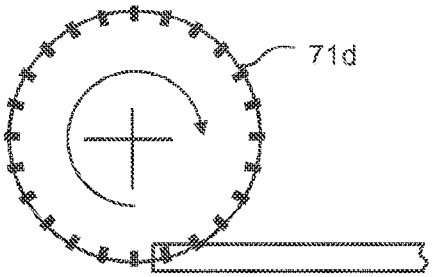
FIGS. 4*a*-4*d* show an alternative production method to form cavities in an edge of a panel.
Figure 4B:
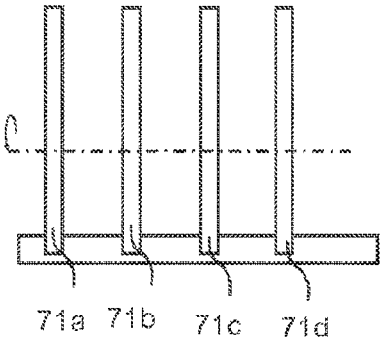
Figure 4C:
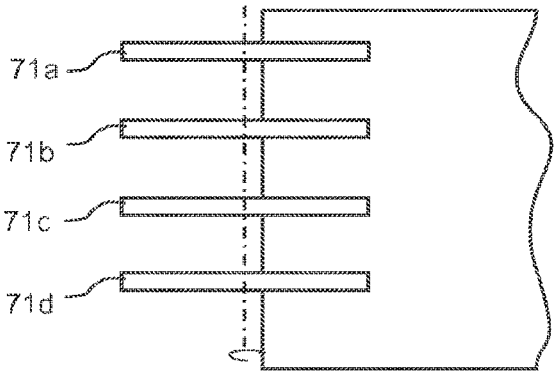
Figure 4D:
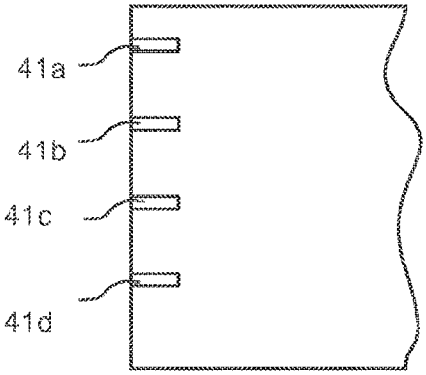

FIG. 3*e* shows a cavity, which is larger than the diameter, if the panel and the tool are displaced in relation to each other. FIG. 3*f* shows a cavity, which is formed, as a blind hole comprising a solid upper part and an opening.

FIGS. 4*a*-4*d* show that the above mentioned forming could also be made with a saw blade principle where preferably several saw blades 71*a-d* preferably on the same axes, forms cavities 41*a-d*. The cavities are in this embodiment smaller than the diameter of the saw blades. They could of course be equal or larger.

FIGS. 5*a*-5*d* show a method to form the above mentioned cavities 41*a-f* with a screw cutter principle. Such forming could be produced in a very cost efficient way in a continuous production line and with high accuracy especially if the panel position and speed is synchronized accurately with the tool position and the tool rotation speed. The screw cutter 72 could be used as separate equipment or more preferably as an integrated tool position in a double-end tenoner. The panel edge is displaced essentially parallel to the axis of rotation AR of the screw cutter tool 72. It is possible to produce any shape, with round or sharp cavities. The cutting could take place before, after or in connection with the profile cutting.

Figure 5A:
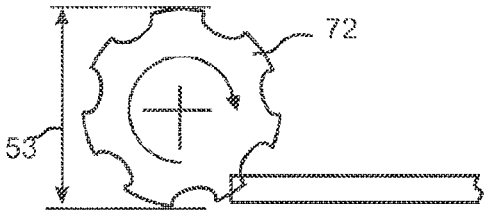
FIGS. 5*a*-5*d* show a production method using a screw cutter to form cavities in an edge of a panel.
Figure 5B:
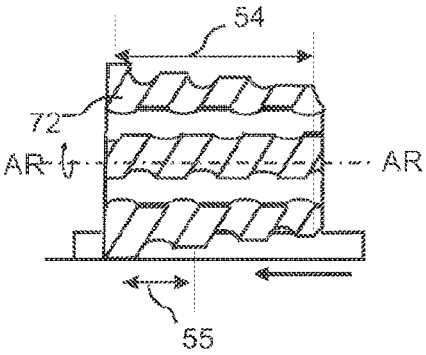
Figure 5C:
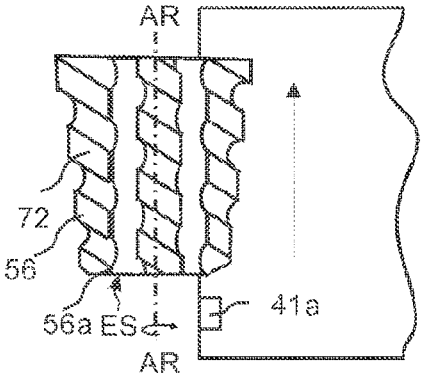
Figure 5D:
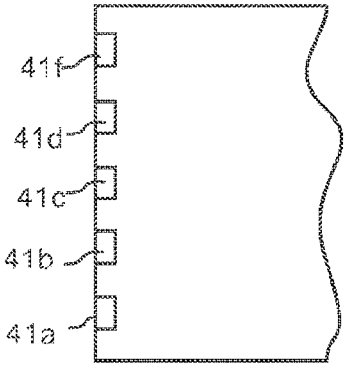

The position in the length direction of a cavity formed on a panel edge depends on the position of the first entrance tool tooth 56*a* that comes into contact with the panel edge as shown in FIG. 5*c*. This means that the rotation of the tool must be adjusted to the panel edge that is moved towards the tool. The position between cavities could be very accurate if the tool rotation is adjusted and synchronized with the speed that the panel is displaced in relation to the screw cutter. Such an adjustment of the position of the first entrance tool and the tool rotation could be made by measuring the position of a panel edge and the speed of a transportation chain or a belt or the driving device that moves the chain or the belt. It is possible to obtain very accurate machining of the cavities and to position the first cavity at a pre-determined position from the edge with a tolerance of about ±0.2 mm or even lower. The diameter 53 of the shown screw cutter tool 72 should preferably be smaller on the entrance side ES than on the opposite exit side. The screw cutter tool could however have the same diameter 53 over the whole length 54. The increased cutting depth could in such a tool configuration be reached with an axis of rotation that is slightly angled in relation to the feeding direction of the panel edge.

The pitch 55 of the tool configuration defines the intermediate distance of the cavities. It is therefore very easy to form a lot of cavities and protrusions with very precise intermediate distances over a considerable length of a joint. The teeth 56 of a screw cutter are preferably made of industrial diamonds.

Cavities could also be formed with a large rotating tool similar to a saw blade, which comprise cutting teeth on only a portion of the tool body. This is a simple variant of the screw cutter principle and each rotation forms one cavity. The advantage is that the intermediate distance between the cavities could be changed by an adjustment of the tool rotation speed or the feeding speed of the panel.

A planned or unplanned production stops where the displacement of a panel is stopped is a problem if the screw cutter is integrated with the profiling equipment since the screw cutter will destroy all cavities of a panel that are in contact with the tool teeth. This problem could be solved with production methods comprising the following steps where some or all steps could be used independently or in combinations.

a) The panel is always stopped when is has passed the crew cutter tool and after a full production of all cavities located on a panel edge. This method is used for all planned stops. The screw cutter is displaced away from the panel edge when a panel is stopped at a position, which does not allow a full production of all cavities on an edge. Such panels with partly produced cavities are detected and rejected from normal production.

b) The screw cutter is displaced away from the panel edge when the panel stops. The transportation device is then reversed. The screw cutter is moved back to its original position and the panel is produced in the normal way.

c) The screw cutter comprises a moving device that allows that it could be displaced parallel to the panel edge and against the feeding direction of the panels when a panel stops. The screw cutter is displaced such that its teeth pass the panel edge of a stopped panel. All cavities will always be fully machined even when an emergency break occurs. The screw cutter returns to its original position when the transportation device starts and a new panel is produced in the normal way.

The displaceable screw cutter method as described in c) above offers the advantages that conventional profiling equipment could be used without any modification of the transportation device or the control systems.

The above described production methods to form cavities with a crew cutter could be used in all type of panel machining and especially in such machining where cavities are formed which comprises parts of a mechanical locking system for floor panels.

Figure 6A:
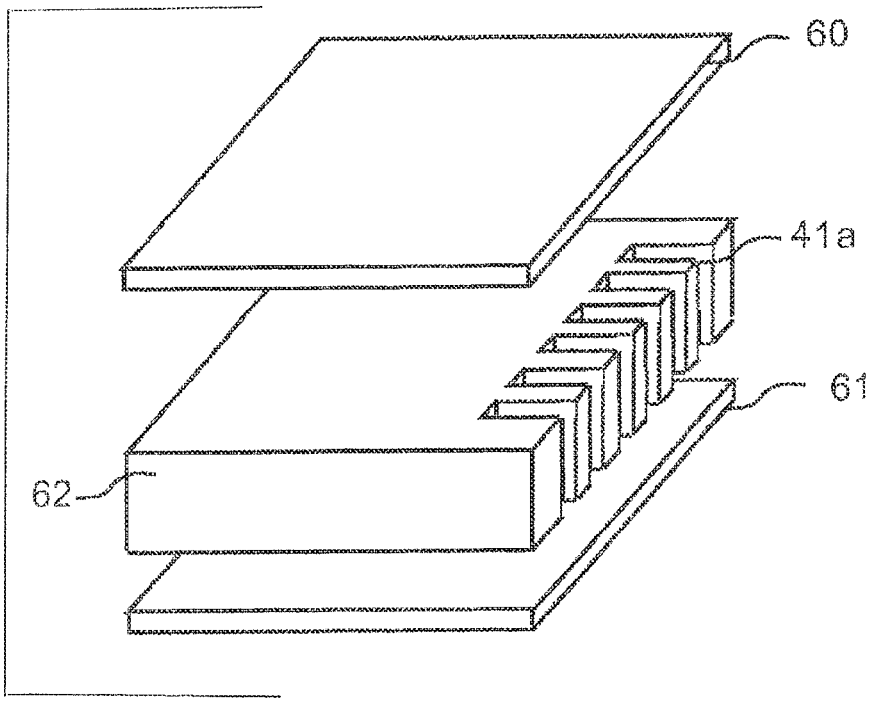
FIGS. 6*a*-6*b* show how cavities could be formed in a core of a panel prior to applying a surface layer on the core.
Figure 6B:
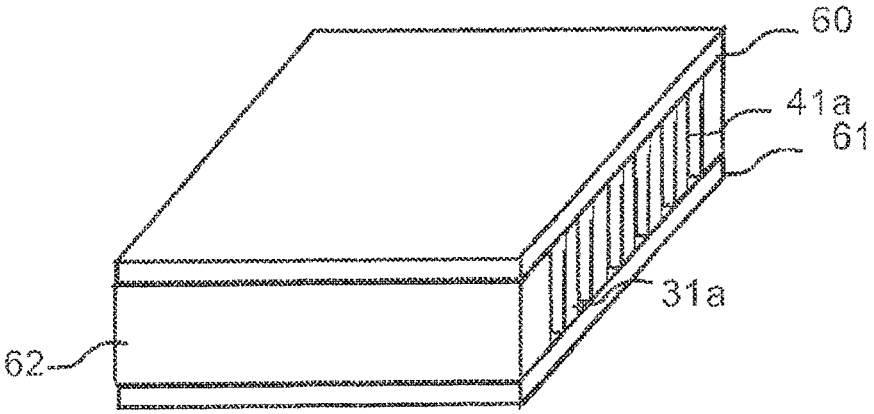

FIGS. 6*a*-6*b* show that forming of cavities could be made before the profile cut. A separate material 62 or a panel core with protrusions cavities 41*a* could be connected to an edge of the floorboard and preferably glued between a surface layer 60 and a balancing layer 61 in a wood or laminate floor.

Figure 7A:
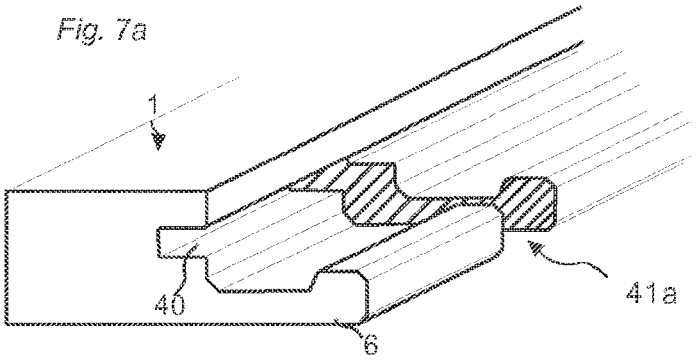
FIGS. 7*a*-7*d* show a locking system with cavities formed by saw blades.
Figure 7B:
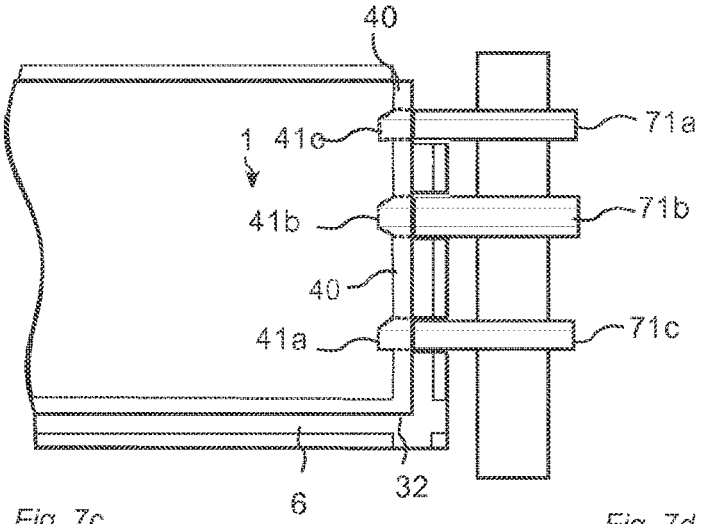
Figure 7C:
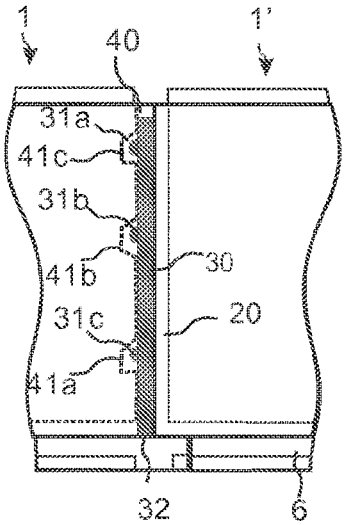
Figure 7D:
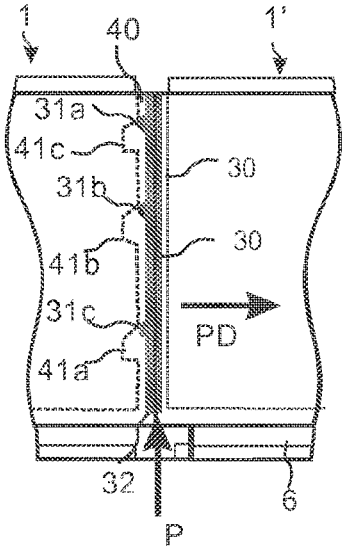

FIGS. 7*a*-7*d* show that the describe methods to form cavities in an edge could be used to displace a displaceable tongue 30 from one displacement groove 40 into an adjacent tongue groove 20 as described in FIGS. 1*a*-1*d*. One or several cavities 41*a*-*c* with horizontally extending inclined or parallel walls could be formed by cutting through the strip 6 and such an embodiment and production method is more cost efficient than the known methods where thin horizontally cutting saw blades are used to make a cavity. The cavities could preferably be formed with jumping tool heads 71*a*-71*c*, mounted on the same tool shaft, and which are displaced towards the rear side when the panel is displaced in relation to the jumping tool heads. The panel could of course also be displaced towards the saw blades vertically or horizontally. The jumping heads could be mounted in the same machine that forms the long edges and the forming of the cavities could be made in a cost efficient way in line with the forming of the locking system. The jumping heads could also be displaced along the feeding direction and the relative speed between the displacement of the jumping heads and the displacement of a panel edge could also be used to obtain cavities with an opening, which is larger than the width of the rotating tools. Jumping non-rotating scraping tools could also be used to form cavities or protrusions. FIG. 7*c* shows a displaceable tongue in an unlocked position with its protrusions 31*a*-*c* located in the cavities 41*a*-*c*. FIG. 7*d* shows the locked position when the tongue 30 has been displaced along the edge with a side pressure P applied at an edge section 32 of the displaceable tongue 30. The protrusion will during this displacement slide along the walls of the cavities and force the tongue to move perpendicularly PD to the edge and lock into the adjacent tongue groove 20.

FIGS. 8*a*-8*e* show an embodiment with a cavity 41*a* formed as a blind hole. A cutter 80*a* with a diameter of for example 5-15 mm could be used and one or several cavities 41*a*-41*c* shaped as blind holes could be formed from the rear side as shown in FIGS. 8*a*-8*d*. The panel and/or the cutter 80*a* are displaced vertically towards each other during machining. The cavities could be positioned such that they cooperate during locking with protrusions 31*a*-31*d* located on the inner part of the tongue 30 as shown in FIGS. 8*d*-8*f*. Such an embodiment will make it possible to form a very strong and stable edge since the cutters 80*a* will remove very small amounts of material.

FIGS. 9*a*-9*d* show an embodiment with cavities 41*a*-*d* formed with a cutter and where the cutter and/or the panel are displaced horizontally during machining. It could be an advantage to use such a production method in some application. The cutters could for example be stationary or fixed to a jumping tool head that also could be displaceable along the feeding direction of the panel.

Figure 10A:
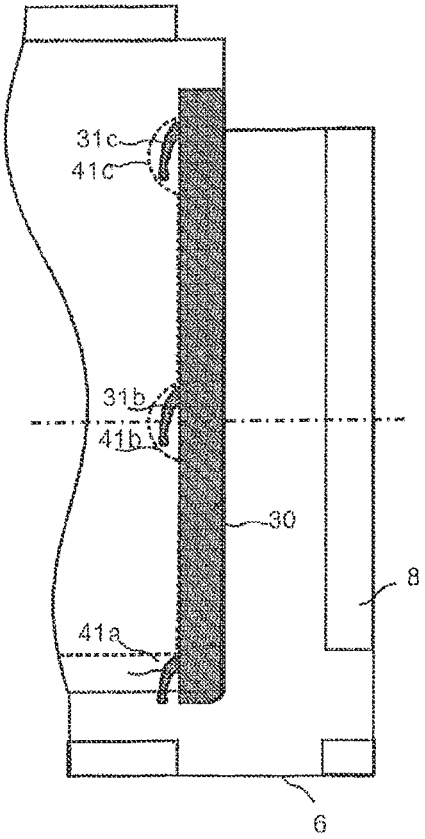
FIGS. 10*a*-10*e* show a locking system with a displaceable tongue comprising flexible protrusions.
Figure 10B:
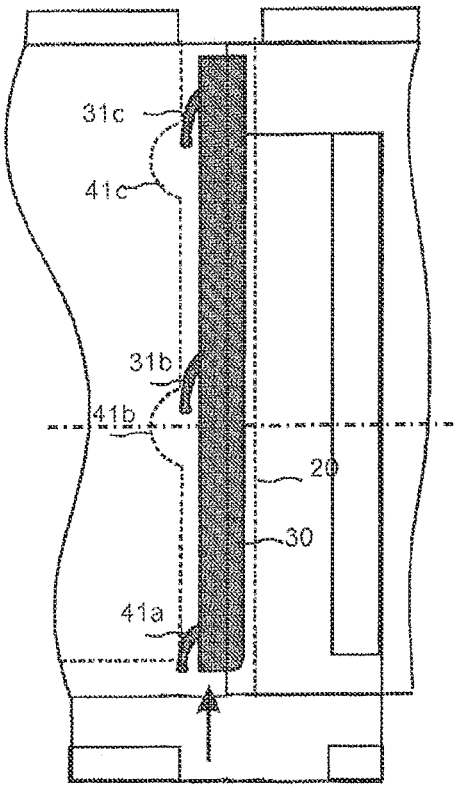
Figure 10C:
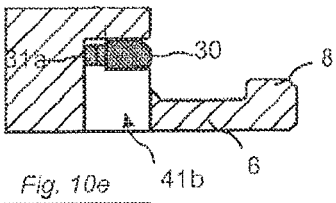
Figure 10D:
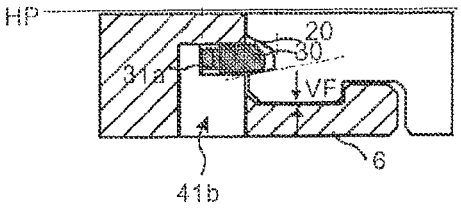
Figure 10E:
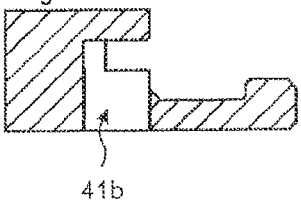
Figure 11A:
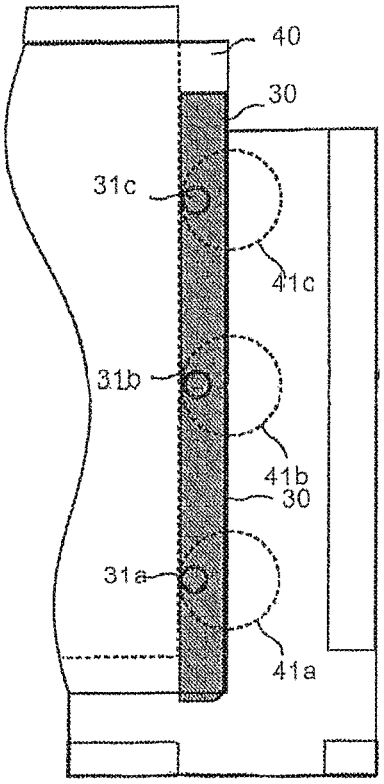
FIGS. 11*a*-11*d* show a locking system with a displaceable tongue comprising protrusions at the lower part of the tongue.
Figure 11B:
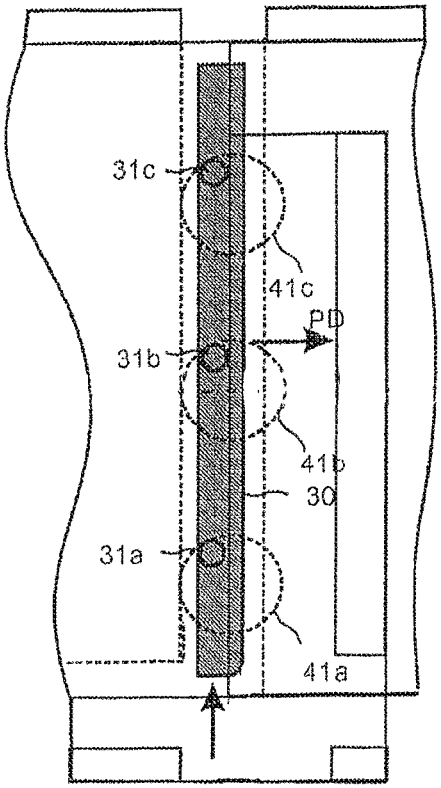
Figure 11C:
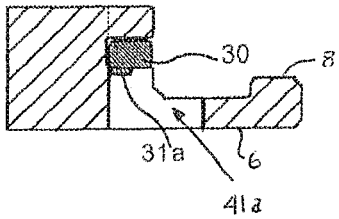
Figure 11D:
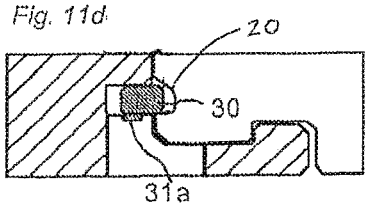
Figure 12A:
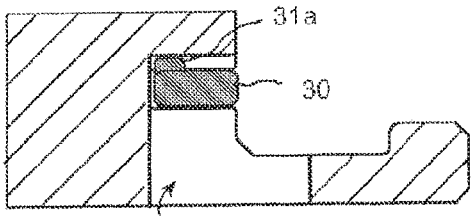
FIGS. 12*a*-12*f* show a locking system with a displaceable tongue comprising protrusions on upper and/or lower parts of the tongue.
Figure 12B:
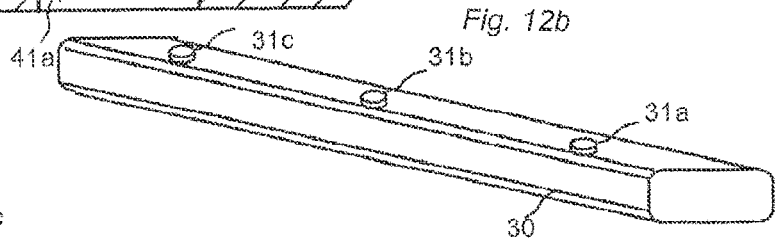
Figure 12C:
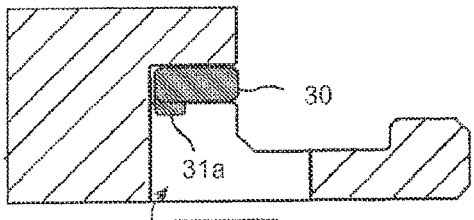
Figure 12D:
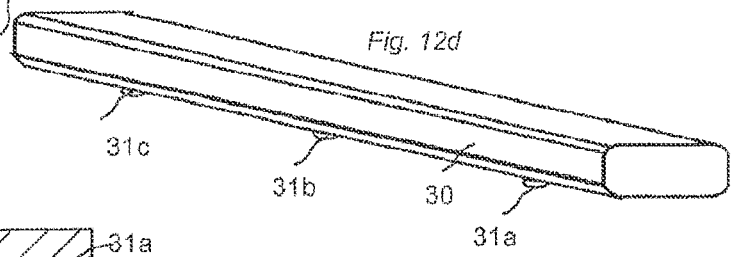
Figure 12E:
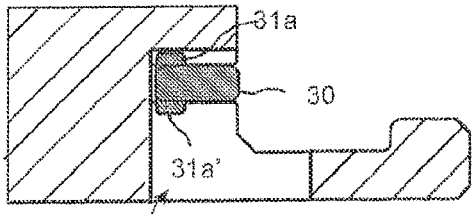
Figure 12F:
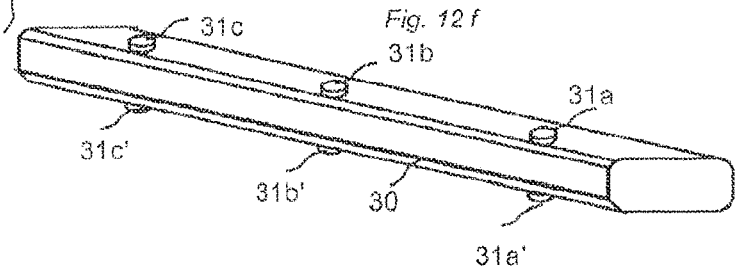

FIGS. 10*a*-10*e* show that protrusions 31*a*-*c* could be made flexible and this could be used to compensate for production tolerances and to create a horizontal pre tension between the tongue 30 and the tongue groove 20 such that a vertical pressure force VF could be created between the upper part of the strip 6 and the adjacent panel as shown in FIG. 10*d*. The vertical pressure force VF is preferably caused by contact surface between the tongue 30 and the tongue groove 20 which are slightly inclined in relation to the horizontal plane HP.

FIGS. 11*a*-11*d* show that protrusions 31*a*-31*c* which during locking cooperate with cavities 41*a*-41*c* could be formed on for example the lower part of the displaceable tongue 30. The depth of the displacement groove 40 could be decreased considerably and this will increase the moisture stability and the strength of the joint.

FIGS. 12*a*-12*f* show that protrusion 31*a*-*c*, 31*a*'-*c*' could be formed on the upper and/or lower part of the displaceable tongue 30. Such protrusions could during locking cooperate with cavities 41*a* located above and/or below the main body of the displaceable tongue 30.

Figure 13A:
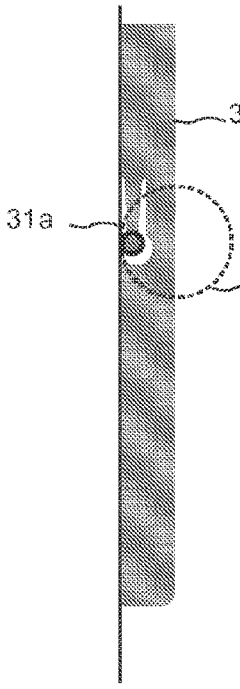
FIGS. 13*a*-13*d* show flexible protrusions on the lower part of a displaceable tongue and production methods to form a stable and strong edge.
Figure 13B:
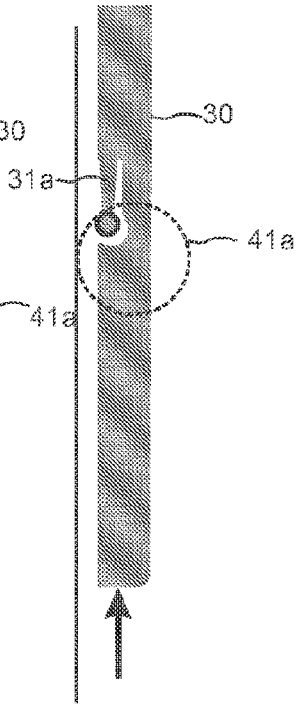
Figure 13C:
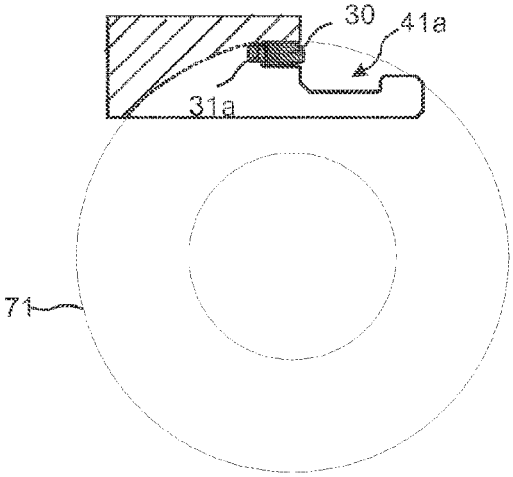
Figure 13D:
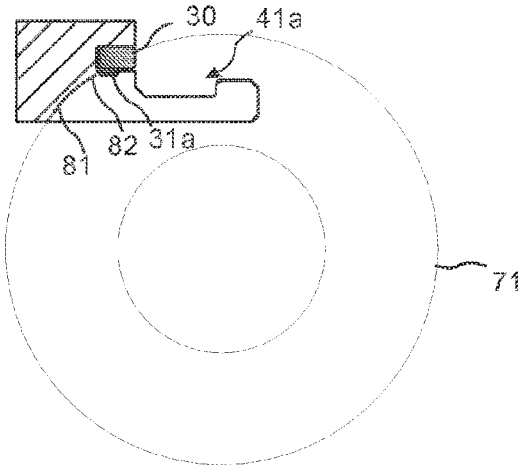

FIGS. 13*a*, 13*b* show that flexible protrusions 31*a* could be formed which protrudes downwardly and/or upwardly from the main body of the displaceable tongue 30. Such protrusion could create a pre-tension in the same way as described above in connection to FIGS. 10*a*-10*d*. FIGS. 13*c* and 13*d* show that a protrusion 31*a* on the lower part of the displaceable tongue 30 give the advantages that the cavity 41*a* could be made considerable smaller, as shown in FIG. 13*d* and this could be used to improve the strength of the edge. Cavities formed by a vertically rotating tool 71 comprise preferably a lower part 81, which is positioned vertically inwardly to an upper part 82 of the cavity. This gives sufficient strength and stability to the edge and allows a cost efficient production.

Figure 14A:
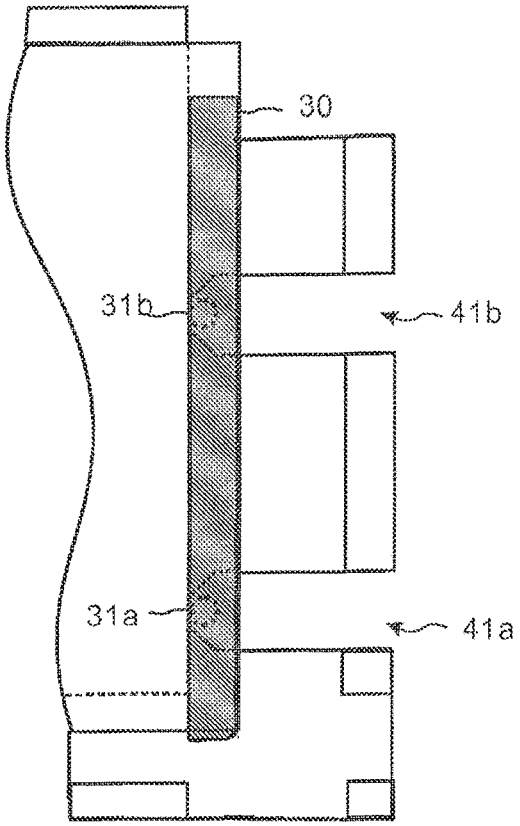
FIGS. 14*a*-14*d* show a locking system with cavities formed by a vertically rotating saw blade.
Figure 14C:
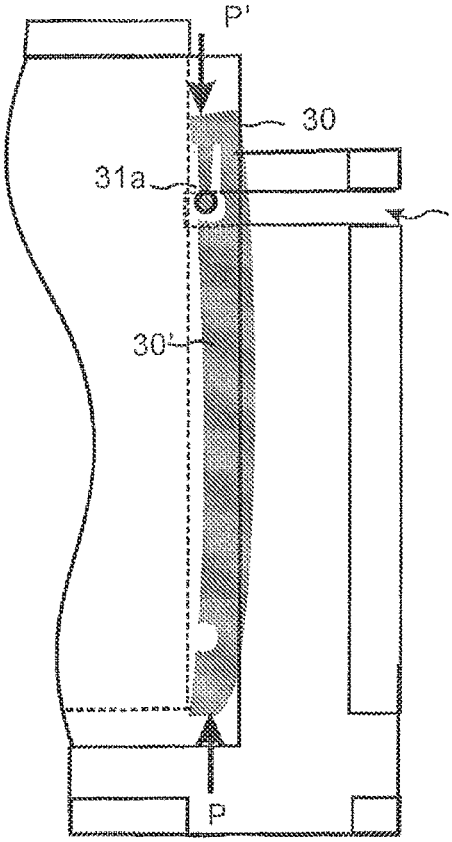
Figure 14B:
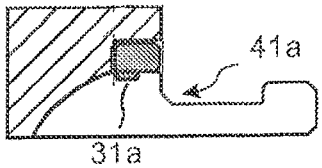
Figure 14D:
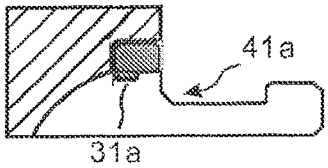

FIGS. 14*a* and 14*b* show a displaceable tongue 30 with protrusions 31*a*, *b* on the lower part and with cavities 41*a*, *b* formed by rotating saw blades. FIG. 14*c*, 14*d* show that all embodiments of the cavities and protrusions could be used to create a counter pressure P' and to bend a flexible tongue 30'. The protrusion 31*a* cooperates with the cavity 41*a* and prevents the tongue to be displaced when a side pressure P is applied. The tongue 30 bends and locks into a tongue groove. This could be used to lock panels in a first row where a counter pressure from a long side in an adjacent row is not possible to obtain in order to bend a tongue.

Figure 15A:
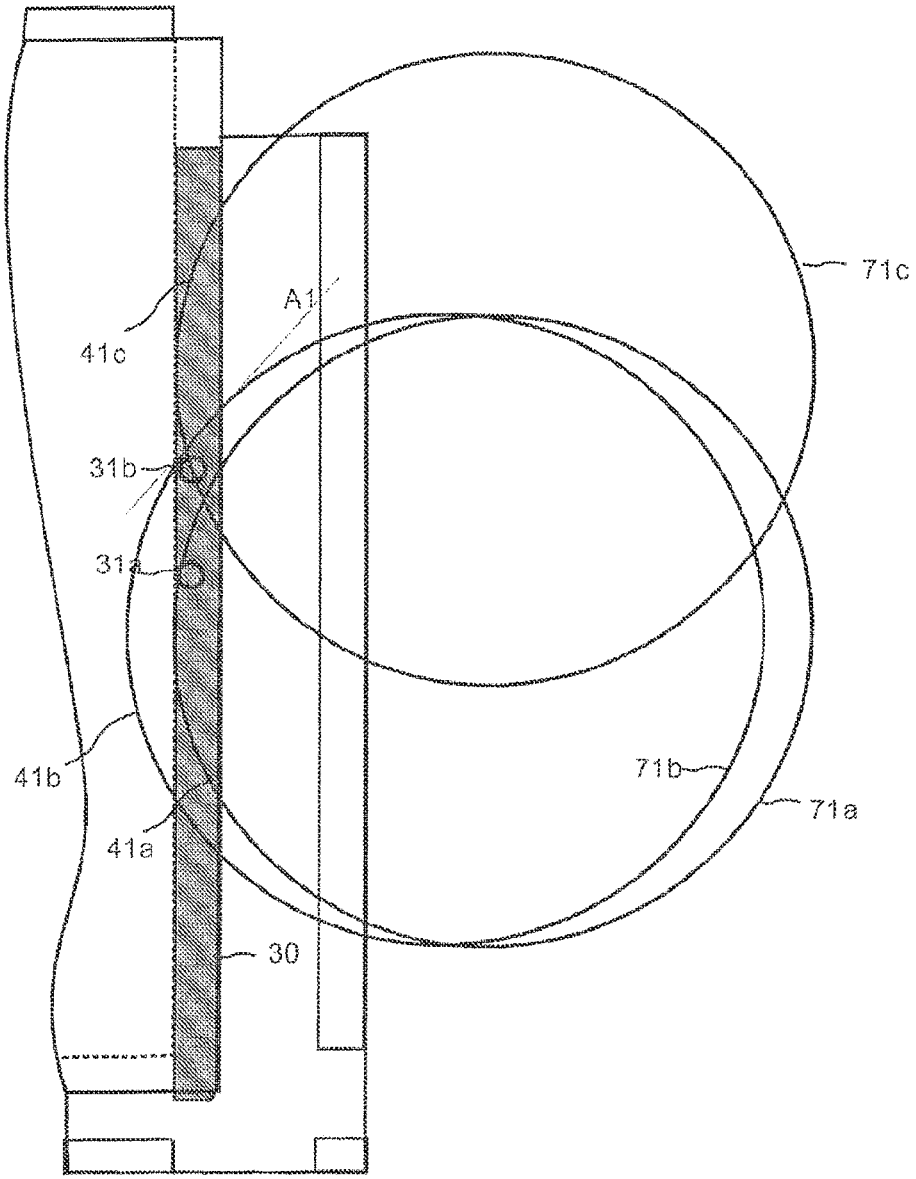
FIGS. 15*a*-15*b* show a locking system with cavities formed by a horizontally rotating saw blade.
Figure 15B:
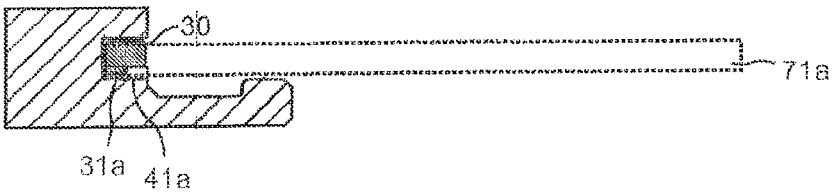

FIGS. 15*a*, 15*b* show that horizontally rotating saw blades 71*a-c* could be used to form cavities 41*a-c* which extend above and/or below the main body of the displaceable tongue 30 and which cooperates with protrusions 31*a, b* located above and/or below the main body of the tongue. One saw blade 71*a* could be vertically offset in relation to another saw blade 71*c*. Such production methods and embodiments could be used to form displacement grooves 40 with limited depth or to increase the angle Al of the perpendicular displacement.

FIGS. 16*a*-16*c* show that it is possible to displace the displaceable tongue 30 perpendicularly to the joint without any additional machining than what is required to form the locking system on long and short edges. Protrusions 31*a*, 31*b* at each edge section of the tongue 30 could be formed that cooperate with the long edge tongue groove 9 and locking groove 14. The protrusion 31*b*, which cooperates with the locking groove 14, is in this embodiment flexible and located on the lower side of the main tongue body. This principle could also be used to bend the flexible tongue described in FIG. 14*c*. The protrusion could be rigid and could for example be formed as a simple wedge part protruding downwards. The vertical extension of the protrusion 31*b* should be such that it allows a locking element 8 of an adjacent long edge to be located in the locking groove 14 and under the protrusion 31*b* as shown in FIGS. 16*a*-16*c*.

Figure 17A:
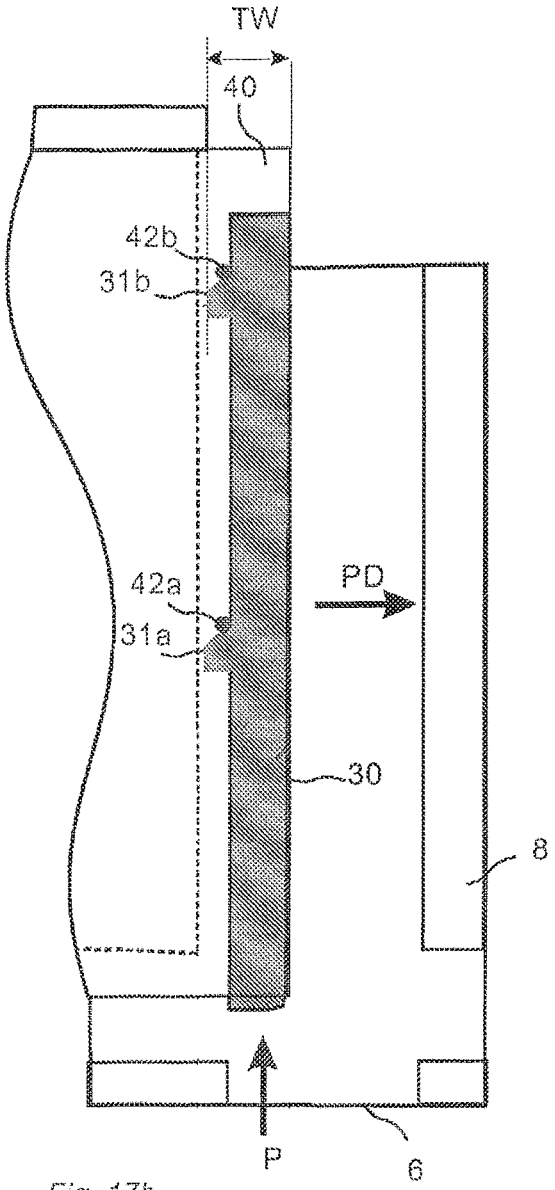
FIGS. 17*a*-17*b* show a locking system with spikes that cooperates with protrusions.
Figure 17B:
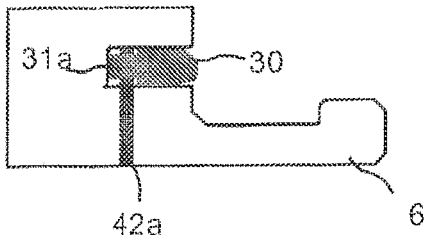

FIGS. 17*a*, 17*b* show that spikes 42*a*, 42*b* could be used to form a vertical wall in a displacement groove 40 and to displace the displaceable tongue 30 perpendicular PD to the joint. The displacement is in the shown embodiment caused by one or several cooperating pairs of spikes 42*a, b* and protrusions 31*a, b*. The spikes 42*a, b* could be made of metal, for example soft steal or aluminium, or plastic or even hard wood. Such embodiments could also be used to bend a flexible tongue. Spikes could of course also be connected horizontally or in an angle into the displacement groove 40.

Figure 18A:
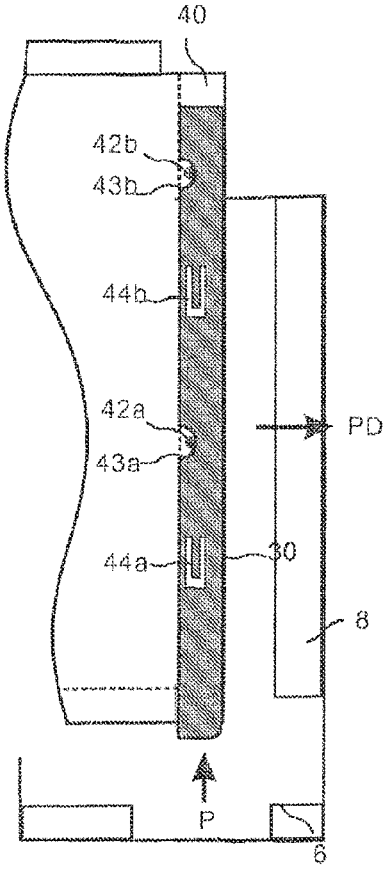
FIGS. 18*a*-18*e* show a locking system with spikes cooperating with recess and an embodiment comprising a displaceable tongue on the groove panel.
Figure 18B:
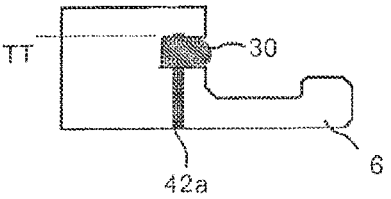

FIGS. 18*a*, 18*b* show that a displacement could also be accomplished by the use of one or several spikes 42*a, b* that cooperate with one or several recesses 42*a, b*. formed preferably at the inner part of the displaceable tongue 30. The displaceable tongue comprises in this embodiment one of several friction connections 44*a, b* that are preferably flexible in the vertical direction and that prevent that the tongue falls out from the displacement groove 40. Other type of friction connections could be used.

Figure 18C:
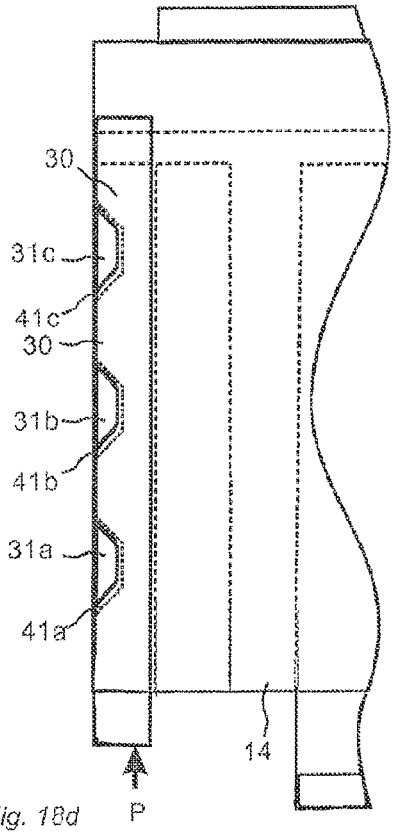
Figure 18D:
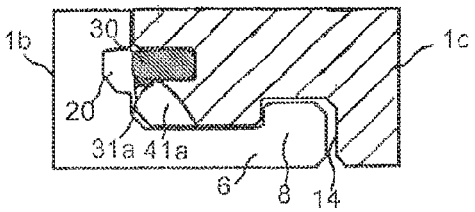
Figure 18E:
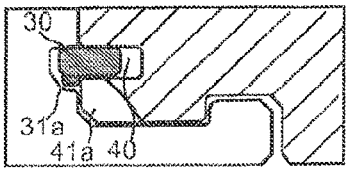

FIGS. 18*c*-18*e* show an embodiment comprising a displaceable tongue 30 located on the groove panel 1*c*, which is intended to be folded on the strip panel 1*b*. FIGS. 18*c* and 18 *d* show the displaceable tongue 30 in an unlocked position and FIG. 18*e* shows the locked position when the displaceable tongue 30 has entered into the tongue groove 40. The perpendicular displacement is in this embodiment caused by cooperation between one or several protrusions 31*a-c* located on the lower side of the displaceable tongue and one or several cavities 41*a-c* which in this embodiment are located under the main tongue body. The cavities (41*a-c*) could preferably be formed by a screw cutter. Such an embodiment offers several advantages. A limited amount of material has to be removed from the panel edge in order to form the cavity. The cavities are also easy to form since there is no strip protruding from the edge. The displaceable tongue 30 is also easy to insert into the displacement groove which could be formed with a limited depth due to the fact that the protrusion 31*a* and the cavity 41*a* extends downwards from the lower part of the main tongue body.

Figure 19A:
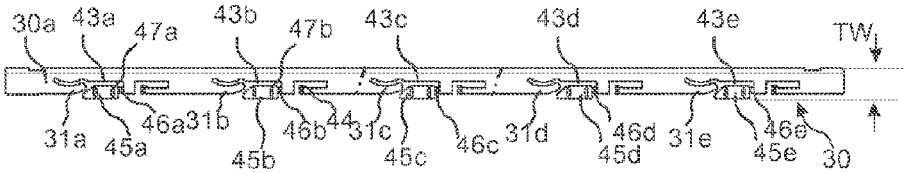
FIGS. 19*a*-19*e* show a locking system with a one piece displaceable tongue that after insertion is separated into several unconnected parts.

FIGS. 19*a*-19*e* show a displaceable tongue 30 according to one embodiment of the invention. The displaceable tongue 30 is made in one piece, preferably by injection mounding of a preferably thermoplastic material. FIG. 19*a* show a displaceable tongue 30 comprising a main tongue body 30*a* and one or several wedge parts 45*a-e*, which are fixed to the main tongue body with wedge part connections 46*a-e*, located preferably partly in or adjacent to tongue recesses 43*a-e* formed in the main tongue body (30*a*). The wedge parts comprise wedge friction connections 47*a, b*. The main tongue body 30*a* comprises preferably one or several tongue friction connections 44 and preferably one or several flexible protrusions 31*a-e* preferably extending essentially in the length direction of the displaceable tongue body 30*a*.

FIGS. 19*b*-19*e* are enlargements of a tongue section according to FIG. 19*a*.

The tongue friction connection 44 is preferably flexible. Such tongue friction connections, which could be used to create a controlled pre tension against an upper and/or lower wall of the displacement groove 40, keep the tongue in the displacement groove in a controlled way and prevent that the tongue falls out from the displacement groove. The flexible tongue friction connection 44 allows a smooth and easy displacement along the joint and eliminates the need for tight production tolerances when the displacement groove is formed. The wedge parts 45 comprise one or several wedge friction connections 47 that could be formed as vertically extending small protrusions. Such protrusions could also be flexible.

The wedge friction connections 47 should preferably be designed to create a friction, which is larger than the friction created, by the tongue friction connections 44. The wedge friction connections 47 should create a firm connection between the wedge parts 45 and the displacement groove 40 and prevent that the wedge part 45 is displaced when the main tongue body 30*a* is displaced along and perpendicular to the joint during locking. Such a firm friction connection could be accomplished for example with a displacement groove which is formed with a smaller vertically extending opening in an inner part than in an outer part of the groove. The inner part of a wedge friction connection could be pressed against the upper and lower parts of the displacement groove during locking when the main tongue body 30*a* creates an inwardly directed pressure against the wedge part 45.

Figure 19B:
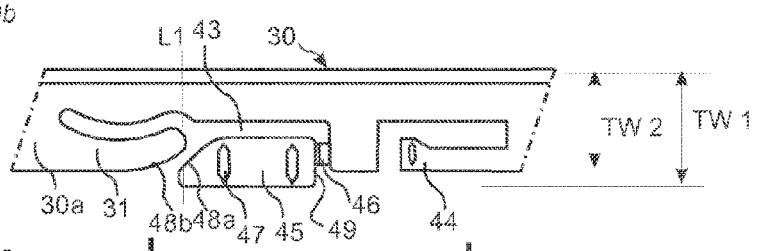

FIG. 19*b* shows that the wedge part 45 forms the outer part of the displaceable tongue when the displaceable tongue is produced and not connected to an edge of a panel. The outer part of the wedge part 45 protrudes partly beyond the main tongue body 30*a*. The width of the displaceable tongue TW 1 is larger than the width of the main tongue body TW 2. The wedge part comprises an inclined or rounded wedge ramp surface 48*a* and a connection surface 49, which in this embodiment is preferably essentially vertical. The flexible tongue protrusion 31 comprises an inclined or rounded tongue ramp surface 48*b*, which is designed to cooperate with the wedge ramp surface 48*a* and to displace the displaceable tongue perpendicularly to the panel edge when a side pressure P is applied on an edge section of the displaceable tongue. It is preferred that the flexible tongue protrusion 31 and the wedge part 45 is formed with overlapping parts in the width direction as indicated by the line L1. The wedge ramp surface is in the shown embodiment inclined 45 degrees against the length direction of the displaceable tongue 30. Other angles could be used. Preferred angles are about 25-60 degrees.

Figure 19C:
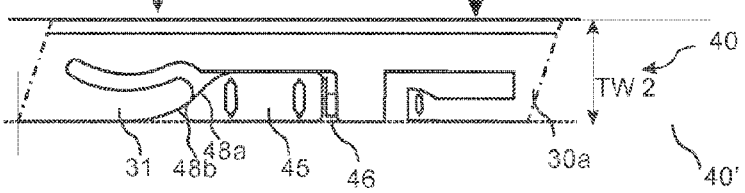

FIG. 19*c* shows that the wedge part 45 is preferably separated from the main tongue body 30*a* when the displaceable tongue 30 is inserted into the displacement groove 40 and pressed towards the inner part 40' of the displacement groove 40. The wedge part connection 46 should preferably be designed such that it breaks when the wedge part 45 is pressed into the recess 43 formed in the main tongue body. The wedge part 45 could alternatively be separated partly or completely before insertion of the displaceable tongue 31 or when a side pressure P is applied during locking. It is preferred that the ramp surfaces 48*a*, 48*b* are in contact or at least overlapping in the width direction of the displaceable tongue when the displaceable tongue is in its inner unlocked position. Such an embodiment will limit the displacement distance DD that is required to accomplish a pre-determined locking distance LD.

Figure 1A:
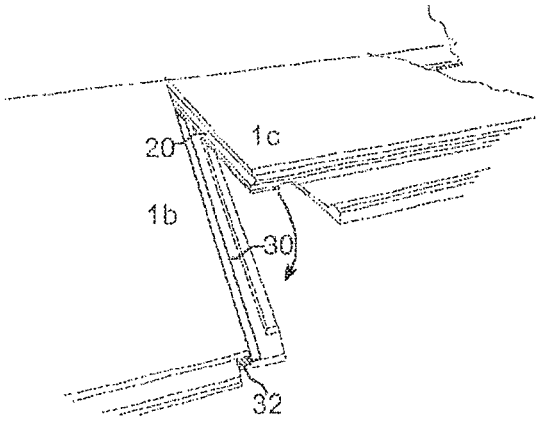
FIGS. 1*a*-1*d* illustrate prior art locking system.
Figure 1B:
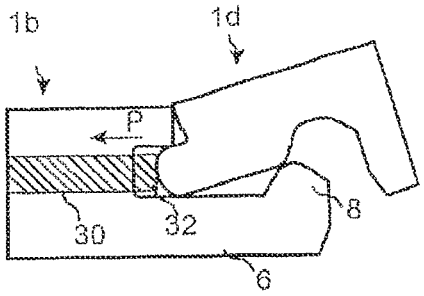
Prior Art Fig. 1b
Figure 1C:
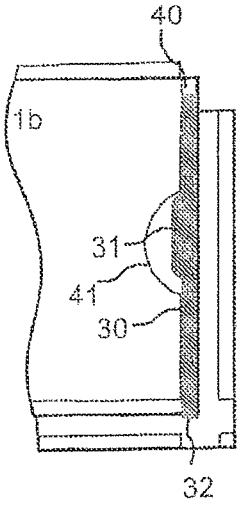
Prior Art Fig. 1c
Figure 1D:
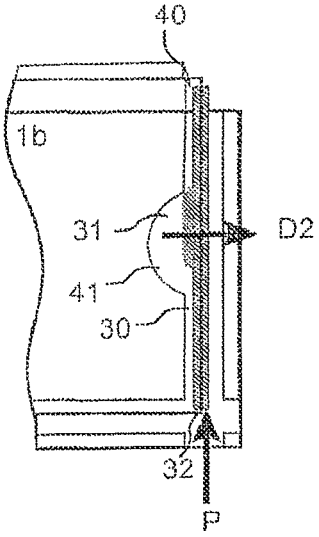
Prior Art Fig. 1d
Figure 2A:
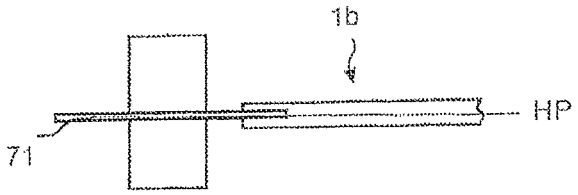
FIGS. 2*a*-2*d* show a prior art production method to for a cavity in an edge of a panel.
Figure 2B:
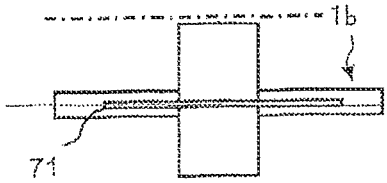
Prior Art Fig. 2b
Figure 2C:
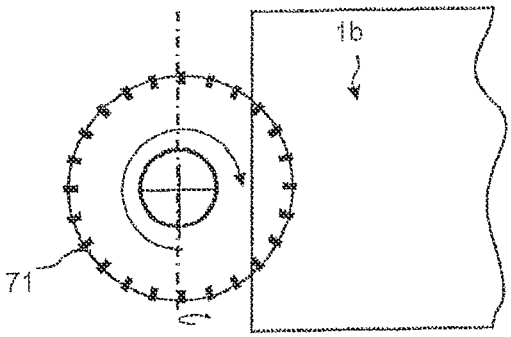
Prior Art Fig. 2c
Figure 2D:
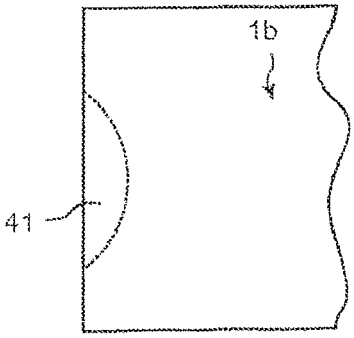
Prior Art Fig. 2d
Figure 19D:
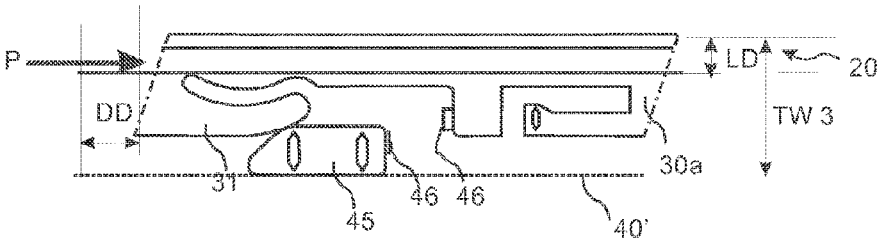
Figure 19E:
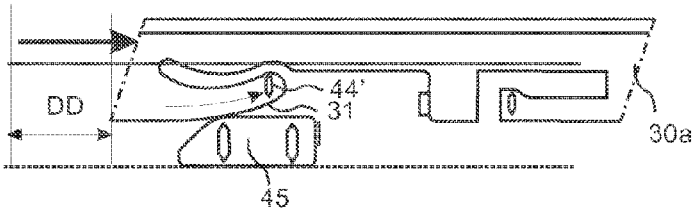

FIG. 19*d* shows the position of the main tongue body 30*a* and the wedge part 45 when a side pressure P is applied on an edge of the main tongue body 30*a* and when the main tongue body has been displace along the displacement groove 40 and into its final locking distance LD where it has obtained its largest tongue width TW 3 and when it is locked to an inner part of a tongue groove 20 of an adjacent panel edge. It is preferred that the displaceable tongue is designed such that the main tongue body could be displaced further in order to enable final angling and locking of another panel 1*d* in another row as shown in FIG. 1*b*. FIG. 19*e* show that such further displacement along the edge will cause the flexible protrusion 31 to bend outwardly towards the outer parts of the main tongue body and the displaceable tongue could be locked with pre tension. The flexible protrusion is an essential part of this embodiment and could be used to eliminate negative effects of production tolerances related to the forming of the grooves and the insertion of the tongue into a groove. Such an embodiment, which allows that the displacement distance DD could be increased while the locking distance LD remains essentially unchanged will increase locking quality and reduce production costs.

The protrusion 31 could be formed such that the pre tension increases when the main tongue body is displaced during the final locking as shown in FIG. 19*e*. The pre tension could also be constant as shown in FIG. 24*a*.

The protrusion 31 could according to one embodiment shown in FIG. 19*e* be formed such that it could flex horizontally inwardly and outwardly during locking but also vertically against an upper or lower part of the displacement groove. Such vertical flexibility could be used to create a friction connection 44' that prevents the main tongue body to fall out from the displacement groove 40. The advantage is that a more rigid tongue body could be formed without any additional flexible friction connections on the main tongue body than the protrusions (31).

The displaceable tongue comprises in this embodiment three tongue widths. A maximum width TW 3 when it is in a locked position, a minimum width TW 2 when it is in an unlocked position and an intermediate width TW 1 between the maximum and minimum width when it is produced and not connected to an edge of a panel.

The minimum tongue width TW 2 is preferably about 4-6 mm, the maxim tongue width TW 3 is preferably 5-8 mm and the intermediate tongue width TW 1 is preferably 5-7 mm. The locking distance is preferably 1-3 mm and the displacement distance preferably DD about 2-5 mm.

Figure 20A:
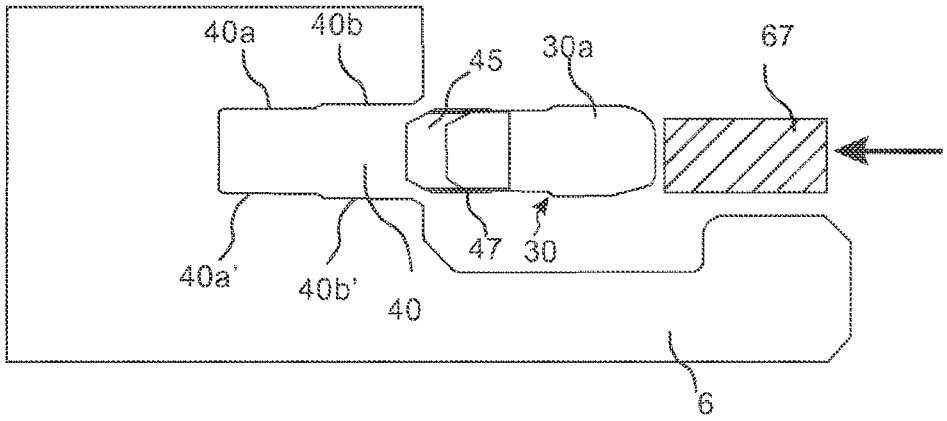
FIGS. 20*a*-20*d* show insertion of a tongue into a groove and locking of a locking system according to the invention.
Figure 20B:
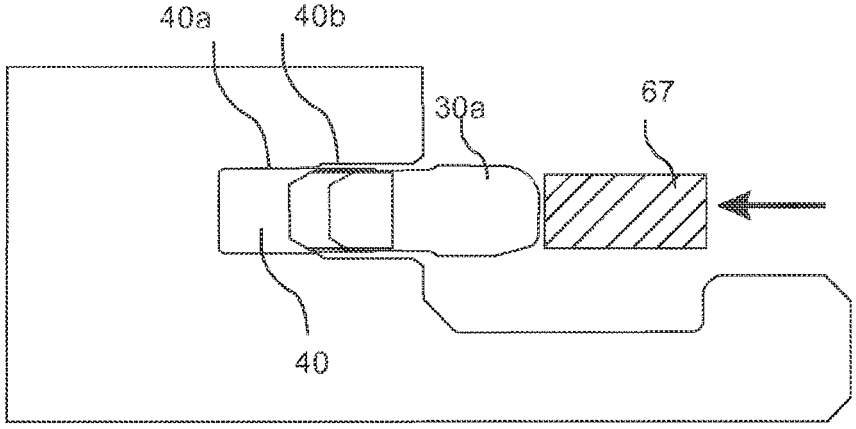
Figure 20C:
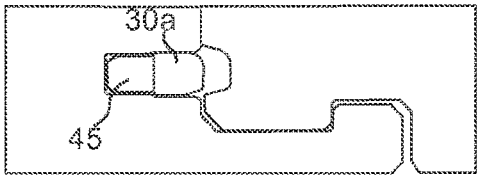
Figure 20D:
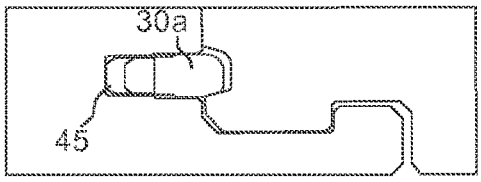

FIGS. 20*a*-20*b* show how a displaceable tongue 30 could be inserted into a displacement groove 40 with a pusher 67. The displacement groove 40 comprises an inner 40*a*, 40*a'* and outer 40*b*, 40*b'* pair of opposite and essentially parallel groove surfaces. The vertical distance between the inner groove surfaces 40*a*, 40*a'* is smaller than between the outer 40*b*, 40*b'*. Such a groove could be used to separate the wedge part 45 in a controlled way during insertion since the wedge part will be released when the main tongue body 30*a* has entered the groove and it will prevent the wedge part to turn or twist during insertion. FIG. 20*c* shows a cross section of a locking system in unlocked position and FIG. 20*d* in locked position.

Figure 21A:
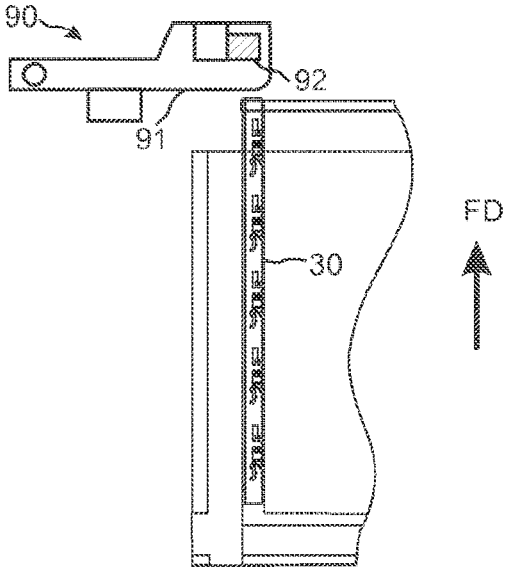
FIGS. 21*a*-21*c* show a method to position a tongue in a groove.
Figure 21B:
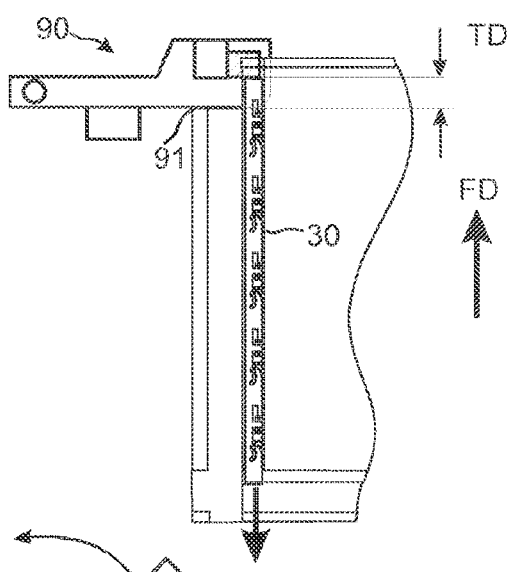
Figure 21C:
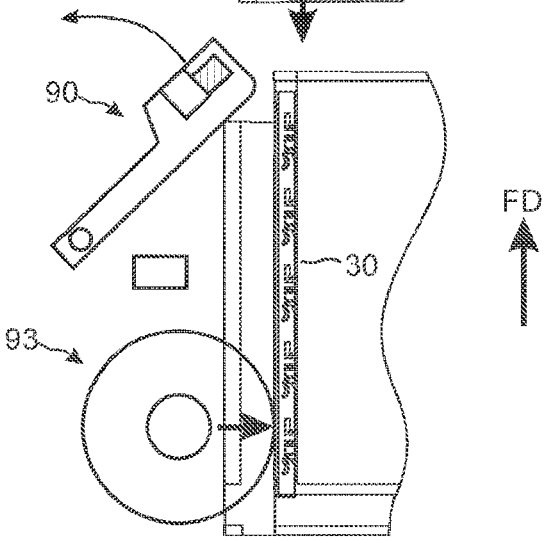

It is essential that the tongue is fixed to the displacement groove in a rather precise manner. This could be accomplished with inserting equipment that inserts a tongue into a groove and a positioning device 90 that positions a tongue at a pre-determined and precise distance from a panel corner after insertion as shown in FIGS. 21*a*-21*c*. The positioning device 90 comprises a panel contact surface 91 and a tongue edge contact surface 92. These surfaces could be aligned or offset in the feeding direction with a pre-determined tongue distance TD. The displaceable tongue is preferably always connected in a position that requires a displacement in one direction, preferably against the feeding direction, FD as shown in FIG. 21*a*. The displaceable tongue 30 obtains automatically its pre-determined tongue distance TD (which could be zero) when the panel contact surface 91 is in contact with a panel edge preferably extending perpendicular to the feeding direction FD as shown in FIG. 21*b*. FIG. 21*c* show that a pressure wheel 93 could be used to finally fix the tongue in the correct position. Essentially vertical wedge connection surfaces 49, as shown in FIG. 19*c*, facilitate a controlled push back of the displaceable tongue.

A displacement and positioning in both directions could be obtained by for example a chain or belt comprising several pushers with panel contact surfaces 91 and tongue edge contact surfaces 92. The speed of the chain/belt could be increased and decreased in a controlled way in relation to the displacement speed of the panel such that a contact between the pushers and two opposite edge parts extending perpendicular to the feeding direction is established and the tongue is pushed along or against the feeding direction to its pre-determined position.

The above described production methods could be used to position any type of tongues in any locking system.

The production methods comprising inserting and positioning as described above require however that the tongue body and the wedge parts are displaced in a groove and this could create locking problems due to for example loose wedge parts that could slide during locking. The tongue is therefore most preferably connected and positioned in a pre-determined position during connection and no further adjustments should be required. Such a precise insertion of a tongue in a groove could be obtained if the speed of a pusher or hammer 67 that inserts the tongue is synchronized with the speed of the chain or belt that displaces the panel edge relative to the inserting equipment. Such a precise and controlled insertion could be used to insert any type of tongue or separate parts into a groove.

One tongue cavity and one wedge part could be sufficient to accomplish a locking especially if a flexible protrusion is used in one edge section that cooperates with a corner section of a panel. It is preferred however to use at least two tongue cavities and wedge parts. Such an embodiment provides easier and more controlled displacement and a stronger vertical locking.

Figure 22A:
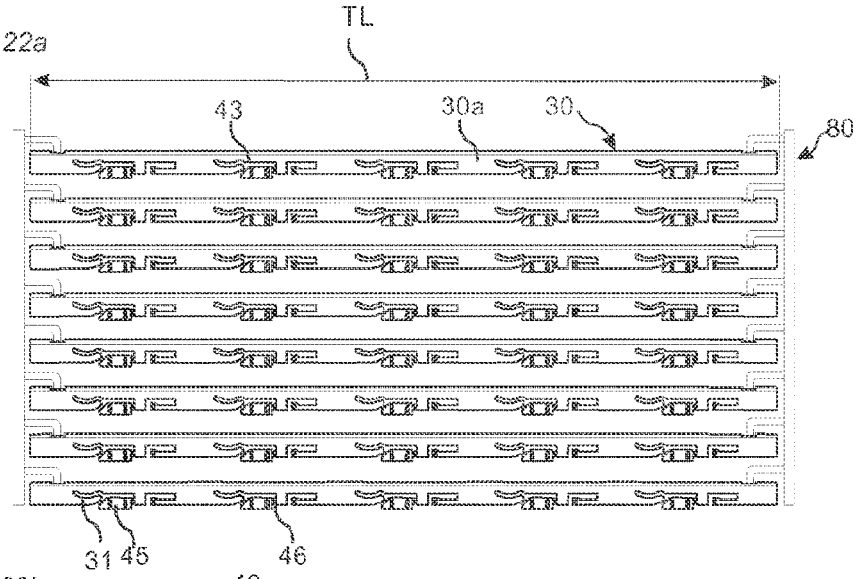
FIGS. 22*a*-22*d* show a tongue blank and an edge of a floor panel during locking.

FIG. 22*a* shows a tongue blank 80 comprising several displaceable tongues 30 according to the embodiments of the invention.

Figure 22B:
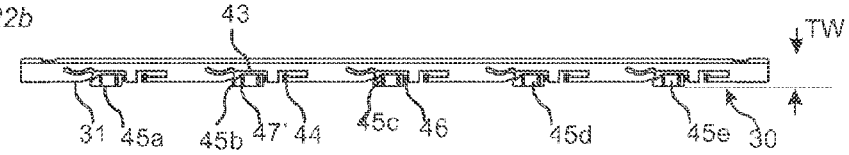
Figure 22C:
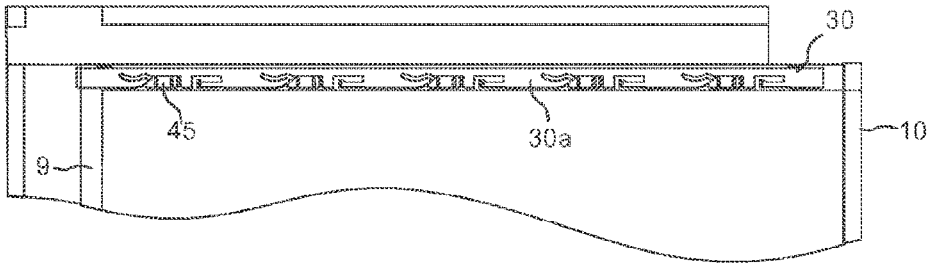
Figure 22D:
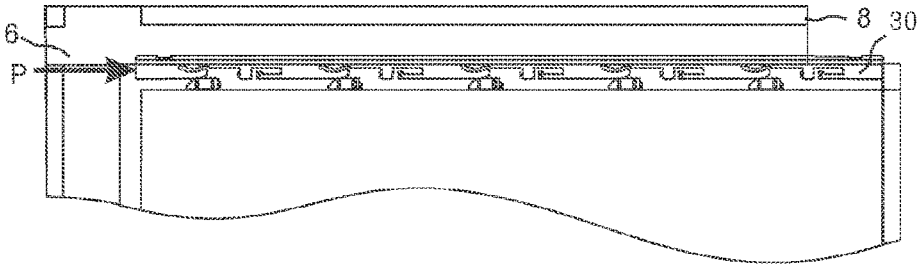

FIG. 22*b* shows a displaceable tongue 30 that has been separated from the tongue blank 80. FIG. 22*c* shows the displaceable tongue in a connected state when the wedge parts 45 have been separated from the main tongue body 30*a*. FIG. 22*d* shows the displaceable tongue 30 in an outer and locked position when a side pressure P is applied on a tongue edge.

Figure 23A:
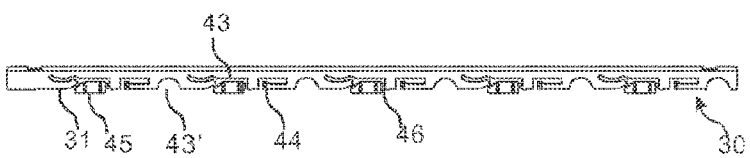
FIGS. 23*a*-23*f* show tongue blanks and locking system at an edge of a floor panel during locking.
Figure 23B:
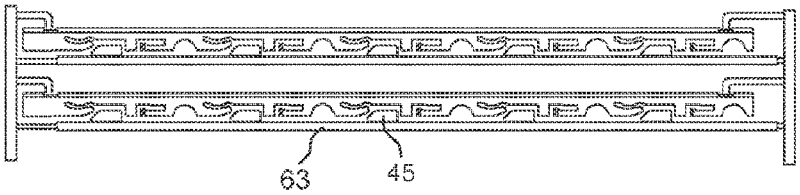
Figure 23C:
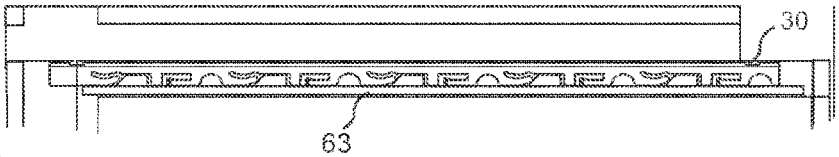
Figure 23D:
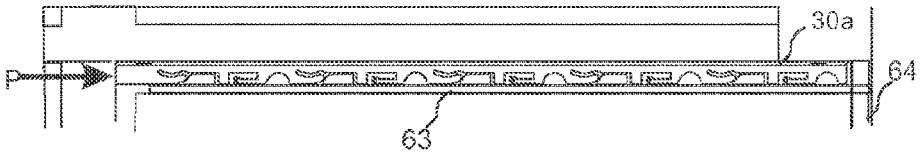
Figure 23E:
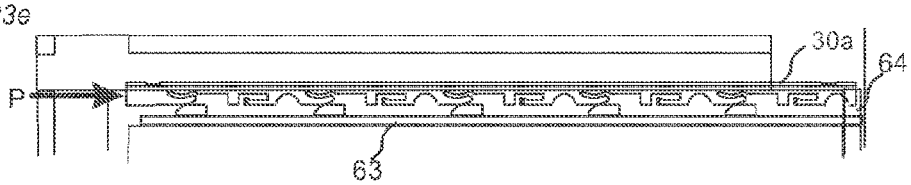
Figure 23F:
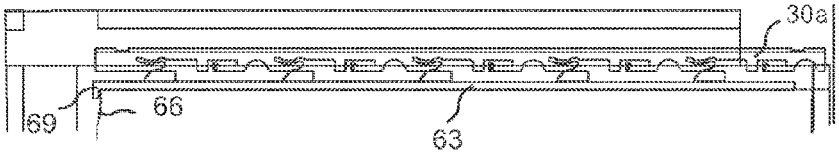

FIG. 23*a* show that recesses 43' could be formed in the main tongue body in order to save material. FIG. 23*b* shows that the wedge parts 45 could be connected to a fixed wedge connection 63. FIG. 23*c-f* show that wedges could be position automatically and that no friction connections are needed. The fixed wedge connection 63 is displaced by the main tongue body 30*a* until an edge of the fixed wedge connection 63 is in contact with a perpendicular edge 64, generally the long edge, of an adjacent panel in an adjacent row as shown in FIG. 23*d*. The wedges are prevented to move further and the main tongue body 30*a* will be displaced perpendicularly to the edge as shown in FIG. 23*e*.

FIG. 23*g* show that the fixed wedge connection could have a wedge hook 69 that is connected to a groove formed on an edge extending perpendicular to the main tongue body 30*a*. The groove that generally is used to receive a tongue of a long edge has in this embodiment an increased depth 66 that preferably is formed by a tool with a jumping head. The advantage is that the wedge connection does not have to be adapted to the panel width.

FIG. 24*a* shows that the protrusion 31 and/or the wedge part 45 could be flexible and create a pre-tension against the tongue groove.

FIGS. 24*b*-24*g* show that protrusions 31*a*, 31*b* could be formed on each side of a wedge and that displacement of a main tongue body 30*a* could be made in both directions along the edge. The wedge part connection 46 is in this embodiment formed on the outer part of the wedge part 45.

FIGS. 24*h* and 24*i* show a simple way to obtain a friction connection that prevents a displaceable tongue of any kind to fall out from the displacement groove 40. A displaceable tongue 30 is formed such that it is slightly bended vertically along its length. Such bending could extend over the whole tongue or over limited sections and could be used to create a pre-tension against the upper and lower part of the displacement groove 40. The tongue is preferably after separation from a tongue blank pressed together by the inserting equipment, such that the bending is eliminated, and inserted into a groove. The bending could be obtained in many ways. A simple bending of a tongue formed of HDF material could for example be accomplished by a local compression 68 on upper and/or lower side of the main body. Different densities could also be used and this could be accomplished for example by machining a HDF board on essentially one side only. HDF could also be reinforced and bended in a controlled way if for example a layer, preferably a paper impregnated with a thermosetting resin, is applied on one side only. Such layer could be laminated and formed with a surface structure, which facilitates sliding and creates a predetermined friction against the groove. The above described friction connection could be used independently to connect any type of tongue, preferably a displaceable tongue, into a groove or in combinations with other friction connections or tongues according to the described embodiments.

All embodiments of the tongues could be formed in a material comprising wood fibers. Such materials could for example be wood fibers mixed with thermoplastic or wood comprising thermosetting resins. Extruded, injection molded or sheet shaped materials could be used. A preferred material is HDF and preferably HDF with a density exceeding 700 kg/cm2. Combinations of machining and/or punching and/or material compression could be used to form tongues or tongue blanks with rather complex three-dimensional forms and which could be used in any application where a separate and/or displaceable tongue is used to lock adjacent panel edges, preferably floor panels. This production method is very cost efficient end environmental friendly.

The invention claimed is:

1. A set of panels comprising a locking system, the locking system comprising a displaceable tongue having a main tongue body and at least two wedge parts located in a displacement groove in a first edge of a first panel of the set of panels, an adjacent second edge of a second panel of the set of panels comprising a tongue groove, the displaceable tongue being configured to lock the first edge and the adjacent second edge together, the main tongue body comprises at least two flexible protrusions and at least two recesses, each of the wedge parts is located at least partly in one of the at least two recesses, the at least two flexible protrusions are slideable against the wedge parts to obtain a displacement of the main tongue body in a direction perpendicular to the first edge and the adjacent second edge and thereby cause locking of the first edge and the adjacent second edge, wherein the at least two flexible protrusions, in an unlocked position, are essentially displaced along the displaceable tongue in relation to the at least two wedge parts and configured to exert a tension against the at least two wedge parts and the tongue groove, wherein the at least two wedge parts comprise a friction connection that inhibits the wedge parts from being displaced in the displacement groove when the main tongue body is displaced along the first edge, and wherein the at least two wedge parts and the main tongue body comprise releasable wedge part connections adapted to be released during the insertion of the displaceable tongue into the displacement groove.

2. The set of panels as claimed in claim 1, wherein the main tongue body comprises a friction connection that allows displacement along the displacement groove and inhibits the main tongue body from falling out of the displacement groove.

3. The set of panels as claimed in claim 1, wherein the main tongue body comprises a flexible friction connection that exerts a pre tension against an upper part and a lower part of the displacement groove.

4. The set of panels as claimed in claim 1, wherein the displaceable tongue has more than two of the at least two wedge parts and more than two of the at least two recesses.

5. The set of panels as claimed in claim 1, wherein one of the releasable wedge part connections is located in one of the at least two recesses.

6. The set of panels as claimed in claim 1, wherein one of the at least two wedge parts is located in one of the at least two recesses between one of the at least two flexible protrusions and one of the releasable wedge part connections.

7. The set of panels as claimed in claim 1, wherein the displacement groove comprises an inner pair of opposite and essentially parallel groove surfaces and an outer pair of opposite and essentially parallel groove surfaces, and wherein a distance between the inner pair of groove surfaces is smaller than a distance between the outer pair groove surfaces.

8. The set of panels as claimed in claim 1, wherein a displacement of the displaceable tongue in a direction along the first edge and the adjacent second edge causes a displacement of the tongue into the tongue groove.

9. The set of panels as claimed in claim 1, wherein a final displacement of the displaceable tongue in a direction along the first edge and the adjacent second edge causes a displacement of the displaceable tongue essentially parallel to the first edge and the adjacent second edge.

* * * * *